US009656790B2

(12) United States Patent
Smith

(10) Patent No.: US 9,656,790 B2
(45) Date of Patent: May 23, 2017

(54) LIQUID DISPENSING CONTAINERS AND BLANKS FOR MAKING THE SAME

(71) Applicant: WestRock Shared Services, LLC, Norcross, GA (US)

(72) Inventor: Kenneth Charles Smith, Hiram, GA (US)

(73) Assignee: WestRock Shared Services, LLC, Norcross, GA (US)

( * ) Notice: Subject to any disclaimer, the term of this patent is extended or adjusted under 35 U.S.C. 154(b) by 0 days.

(21) Appl. No.: 14/831,171

(22) Filed: Aug. 20, 2015

(65) Prior Publication Data

US 2015/0353256 A1 Dec. 10, 2015

Related U.S. Application Data

(63) Continuation of application No. 14/486,806, filed on Sep. 15, 2014, now Pat. No. 9,114,921, which is a (Continued)

(51) Int. Cl.
*B65D 5/72* (2006.01)
*B65D 77/06* (2006.01)

(Continued)

(52) U.S. Cl.
CPC ..... *B65D 77/068* (2013.01); *B31B 1/00* (2013.01); *B31B 1/25* (2013.01); *B31B 1/26* (2013.01); *B31B 1/86* (2013.01); *B31B 1/90* (2013.01); *B65D 5/029* (2013.01); *B65D 5/0227* (2013.01); *B65D 5/16* (2013.01); *B65D 5/4208* (2013.01); *B65D 5/4266* (2013.01);

(Continued)

(58) Field of Classification Search
CPC .. B65D 77/065; B65D 77/067; B65D 77/068; B65D 5/16; B65D 5/746; B65D 5/029; B65D 5/4608; B31B 1/25; B31B 1/26; B31B 1/86; B31B 1/90
See application file for complete search history.

(56) References Cited

U.S. PATENT DOCUMENTS 518,898 A 4/1894 Schmidt
1,585,505 A 5/1926 McIndoe (Continued)

OTHER PUBLICATIONS

Drawing of an 8-sided box labeled 3L BTG. This drawing is undated but was provided to Applicant in an email dated Feb. 1, 2009.

(Continued)

*Primary Examiner* — Gary Elkins
(74) *Attorney, Agent, or Firm* — WestRock IP Legal

(57) ABSTRACT

A container for dispensing beverages is provided. The container includes at least six side walls coupled together along a plurality of parallel fold lines. The at least six side walls include two end panels and at least two side panels, and the at least six side walls define a substantially cylindrical shape of the container. A bottom wall is coupled to at least one of the two end panels, wherein a shape of the bottom wall corresponding to a cross-sectional shape of the at least six side walls. The container further includes a spout cutout removably defined in a first end panel of the two end panels proximate to a fold line connecting the first end panel to the bottom wall.

20 Claims, 8 Drawing Sheets

Related U.S. Application Data continuation of application No. 12/944,346, filed on Nov. 11, 2010, now Pat. No. 8,844,797.

(60) Provisional application No. 61/260,332, filed on Nov. 11, 2009.

(51) Int. Cl.

| | |
|---|---|
| ***B65D 5/02*** | (2006.01) |
| ***B65D 5/74*** | (2006.01) |
| ***B31B 1/26*** | (2006.01) |
| ***B65D 5/42*** | (2006.01) |
| ***B65D 5/16*** | (2006.01) |
| ***B65D 5/468*** | (2006.01) |
| ***B65D 5/46*** | (2006.01) |
| ***B31B 1/25*** | (2006.01) |
| ***B31B 1/86*** | (2006.01) |
| ***B31B 1/90*** | (2006.01) |
| ***B65D 5/60*** | (2006.01) |
| ***B31B 1/00*** | (2006.01) |

(52) U.S. Cl.

CPC ..... *B65D 5/4608* (2013.01); *B65D 5/46096* (2013.01); *B65D 5/60* (2013.01); *B65D 5/746* (2013.01); *B65D 77/062* (2013.01); *B65D 77/067* (2013.01)

(56) References Cited

U.S. PATENT DOCUMENTS

| | | | |
|---|---|---|---|
| 2,156,999 | A | 5/1939 | McNeil |
| 2,496,043 | A | 1/1950 | Farrell |
| 2,772,042 | A | 11/1956 | Hendrick |
| 3,014,637 | A | 12/1961 | Wilson |
| 3,219,240 | A | 11/1965 | Campbell, Jr. |
| 3,526,352 | A | 9/1970 | Swett |
| 3,700,161 | A | 10/1972 | Bundy |
| 4,205,775 | A | 6/1980 | Swan |
| D257,718 | S | 12/1980 | Dutcher |
| 4,260,100 | A | 4/1981 | Hoffman |
| D259,401 | S | 6/1981 | Manning |
| 4,392,607 | A | 7/1983 | Perkins |
| 4,549,690 | A | 10/1985 | Rosenburg |
| D284,552 | S | 7/1986 | Weaver |
| 4,856,705 | A | 8/1989 | Carr et al. |
| 4,903,431 | A | 2/1990 | Stoll |
| 4,967,910 | A | 11/1990 | Schuster |
| 5,050,775 | A | 9/1991 | Marquardt |
| D328,168 | S | 7/1992 | Bartle |
| 5,259,550 | A | 11/1993 | Kuchenbecker |
| 5,348,186 | A | 9/1994 | Baker |
| 5,351,849 | A | 10/1994 | Jagenburg et al. |
| 5,531,375 | A | 7/1996 | Palm |
| D379,759 | S | 6/1997 | Mulry |
| 5,749,489 | A | 5/1998 | Benner et al. |
| D411,079 | S | 6/1999 | Graham |
| 5,938,107 | A | 8/1999 | Anchor et al. |
| 6,237,838 | B1 | 5/2001 | Bradenbaugh |
| 6,443,357 | B1 | 9/2002 | Marbe et al. |
| 6,446,859 | B1 | 9/2002 | Holladay |
| 6,932,266 | B2 | 8/2005 | Jones et al. |
| 7,007,825 | B2 | 3/2006 | Crosland et al. |
| 7,090,115 | B2 | 8/2006 | Pierce |
| D562,129 | S | 2/2008 | Kortsmit et al. |
| D562,130 | S | 2/2008 | Kortsmit et al. |
| 7,350,670 | B2 | 4/2008 | Steeves et al. |
| 7,389,909 | B2 | 6/2008 | Crosland et al. |
| D583,663 | S | 12/2008 | Martini |
| 7,571,835 | B2 | 8/2009 | Hill et al. |
| D617,184 | S | 6/2010 | Sneva |
| D628,884 | S | 12/2010 | Smith |
| D637,488 | S | 5/2011 | Franic |
| 8,720,769 | B2 | 5/2014 | Wall et al. |
| 8,844,797 | B2 * | 9/2014 | Smith ..... B65D 5/0227 229/108 |
| 9,114,921 | B2 * | 8/2015 | Smith ..... B65D 5/0227 |
| 2005/0067476 | A1 | 3/2005 | Hengami |
| 2006/0027638 | A1 | 2/2006 | Jones et al. |
| 2006/0124709 | A1 | 6/2006 | Hengami |
| 2006/0219764 | A1 | 10/2006 | Copeman |
| 2009/0101699 | A1 | 4/2009 | Goudreau et al. |
| 2011/0062223 | A1 | 3/2011 | Wall et al. |

OTHER PUBLICATIONS

Drawing of an 8-sided box labeled Smurfit-Stone and dated May 18, 2004. This 8-sided box was made and sold by Smurfit-Stone in about late 2004 time frame.

JPEG Image; http://www.sfgate.com/c/pictures/2004/12120/wi_bargain_2.jpg; 1 page.

JPEG Image; http:/booizzy.com/archives/boxwing.jpg; 1 page.

JPEG Image; http://www.sheckys.com/userfiles/image/2009/01%20-%20January/012109_BoxedWine_Main.jpg; 1 page.

JPEG Image; http://cutthroatkids.files.workpress.cm/2009/05/dtour.jpg; 1 page.

PNG Image; http://eupgrader.com/wp-content/uploads/2008/09/image40.png; 1 page.

JPEG Image; http://www.apartmenttherapy.com/uimages/kitchen/2009_05_22-BoxWine.jpg; 1 page.

"Hostess With the Mostess"; http://www.hostessblog.com/2006/11/french-rabbit/; 2 pages.

* cited by examiner

LIQUID DISPENSING CONTAINERS AND BLANKS FOR MAKING THE SAME

CROSS REFERENCE TO RELATED APPLICATIONS

This application is a continuation application of U.S. patent application Ser. No. 14/486,806, filed Sep. 15, 2014, entitled "LIQUID DISPENSING CONTAINERS AND BLANKS FOR MAKING THE SAME," which is a continuation application of U.S. patent application Ser. No. 12/944,346, filed Nov. 11, 2010, entitled "LIQUID DISPENSING CONTAINERS AND BLANKS FOR MAKING THE SAME," which claims the priority of U.S. Provisional Patent Application Ser. No. 61/260,332, filed Nov. 11, 2009, the disclosures of each of which are hereby incorporated by reference in their entireties.

BACKGROUND OF THE INVENTION

The embodiments described herein relate generally to containers for dispensing liquids and, more particularly, to polygonal, bag-in-box containers for dispensing a liquid.

At least some known containers are configured to dispense a liquid. At least some of these containers are bag-in-box containers that include an outer box made from paperboard, corrugated paper, or paper/plastic material, and an inner bag that is used to house the liquid material. At least some of these known bag-in-box containers are four-sided containers that are used to transport and dispense a liquid. Unfortunately, these four-sided containers have limitations. For example, these known four-sided bag-in-box containers can require additional paperboard to form the outer box, they can create additional "empty" space within the box allowing the bag to more easily shift around within the box, and they can lack stacking strength.

These known bag-in-boxes are usually rectangular in shape with four sidewalls, a top wall, and a bottom wall. Some known containers include a spout positioned on the top wall or on a sidewall adjacent the top wall. At least some other known containers include a spout on a sidewall adjacent the bottom wall. At least some rectangular containers are used to dispense wine. However, in the past, such wine has been associated with inexpensive, low-quality wine. Recently, higher quality wines have been stored in and dispensed from such rectangular bag-in-box containers, but the negative association with wine in such a container persists.

It is therefore desirable to provide a bag-in-box container that is multi-sided and has a cylindrical shape to more closely resemble a wine bottle. Such a container may be six, eight or even twelve sided. Such a multi-sided container would require less paperboard than a similar four-sided box, and would have improved stacking strength. Such a multi-sided container would also allow for more sophisticated printing on the side of the container since each side panel would more smoothly transition into the next adjoining side panel as compared to a four-sided box. Again, this would improve the look of the container, which is important for the sale of high quality wine. It would also reduce waste, and provide a more secure fit of the bag within the box.

BRIEF DESCRIPTION OF THE INVENTION

In one aspect, a blank for forming a polygonal container configured to include a liquid-impermeable bag having a dispensing fixture is provided. The container facilitates dispensing a liquid from the liquid-impermeable bag when positioned within the container. The blank includes a plurality of substantially rectangular side panels including a front panel and a rear panel. Each side panel has a top edge, a bottom edge, and a height extending between the top and bottom edges. The plurality of side panels are coupled in series along a plurality of fold lines. The blank further includes a first bottom panel connected along the bottom edge of the front panel, a second bottom panel connected along the bottom edge of the rear panel, and a spout cutout removably defined in the front panel proximate to the bottom edge of the front panel. The spout cutout is configured to receive the dispensing fixture for dispensing the liquid from the liquid-impermeable bag when positioned within the container. The plurality of side panels are configured to form at least a six-sided container having a substantially cylindrical shape.

In another aspect, a blank for forming a polygonal container is provided. The blank includes at least six panels coupled in series along a plurality of fold lines, wherein the at least six panels include two end panels and at least two side panels. Each of the at least six panels has a height. At least one bottom panel is connected to a first end panel of the two end panels. The at least one bottom panel having a width, wherein the height is about 1× to about 3× the width. A spout cutout is removably defined in the first end panel proximate to a fold line connecting the first end panel to the first bottom panel.

In yet another aspect, a container for dispensing beverages is provided. The container includes at least six side walls coupled together along a plurality of parallel fold lines. The at least six side walls include two end panels and at least two side panels, and the at least six side walls define a substantially cylindrical shape of the container. A bottom wall is coupled to at least one of the two end panels, wherein a shape of the bottom wall corresponding to a cross-sectional shape of the at least six side walls. The container further includes a spout cutout removably defined in a first end panel of the two end panels proximate to a fold line connecting the first end panel to the bottom wall.

In still another aspect, a method for forming a polygonal container from a blank that includes at least six panels coupled in series along a plurality of fold lines is provided. The at least six panels includes two end panels and at least two side panels. At least one bottom panel is connected to a first end panel of the two end panels, and a spout cutout is removably defined in the first end panel proximate to a fold line connecting the first end panel to the first bottom panel. The method includes rotating the at least six panels about the plurality of fold lines to form at least six side walls each having a height, and rotating the at least one bottom panel about the fold line connecting the first end panel to the at least one bottom panel to form a bottom wall of the container, wherein the bottom wall has a width. The height is about 1× to about 3× the width. A spout is positioned within the spout cutout to dispense a liquid from the container.

BRIEF DESCRIPTION OF THE DRAWINGS

FIG. 1 is a top view of an exemplary embodiment of a blank.

FIG. 2 is a perspective view of a container formed from the blank shown in FIG. 1.

FIG. 3 is a top view of a first alternative embodiment of a blank.

FIG. 4 is a perspective view of a container formed from the blank shown in FIG. 3.

FIG. 5 is a top view of a second alternative embodiment of a blank.

FIG. 6 is a perspective view of a container formed from the blank shown in FIG. 5.

FIG. 7 is a top view of a third alternative embodiment of a blank.

FIG. 8 is a perspective view of a container formed from the blank shown in FIG. 7.

DETAILED DESCRIPTION OF THE INVENTION

Figure 1:
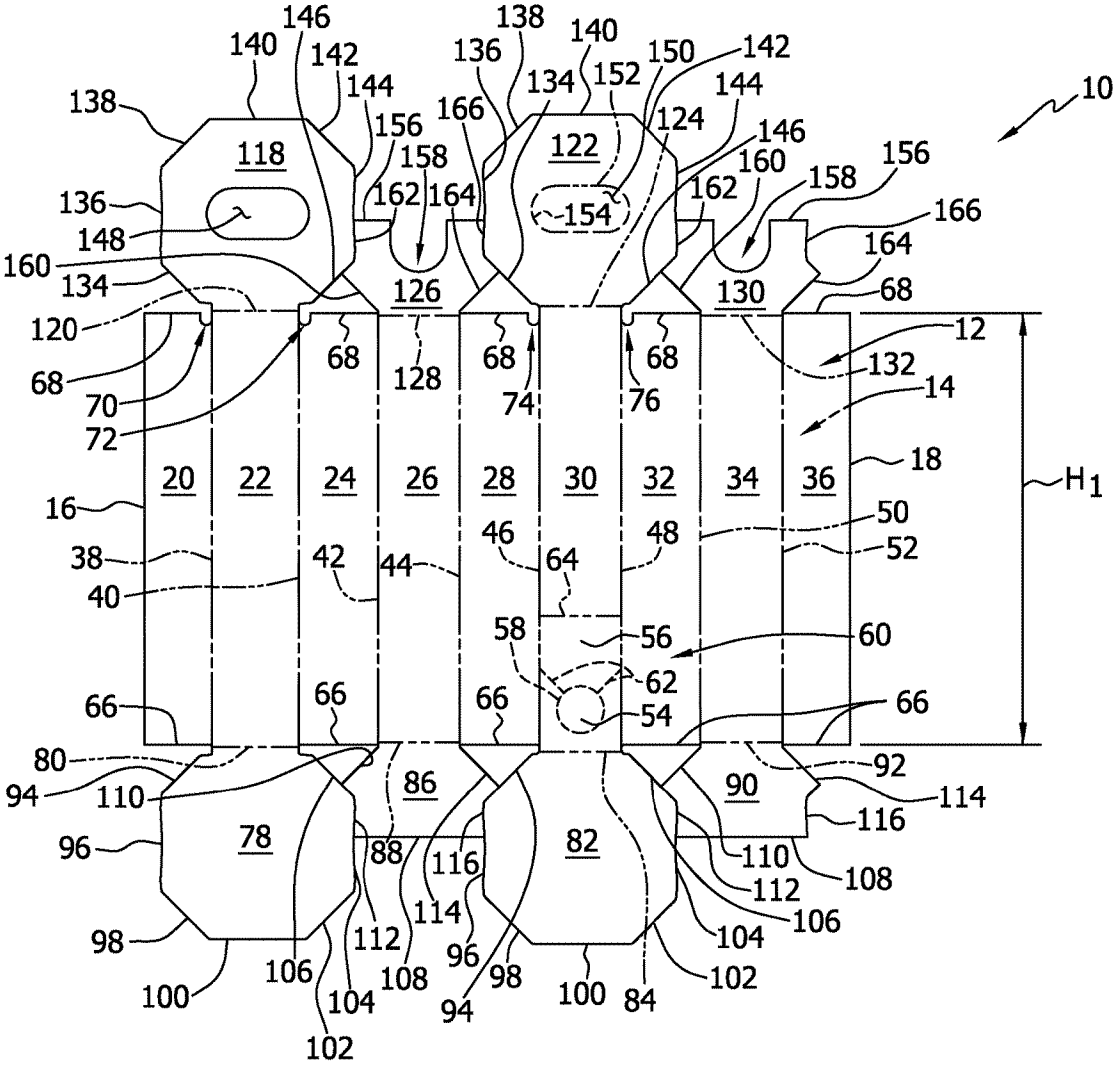
FIGS. 1-8 show exemplary embodiments of the blanks and containers described herein.

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

A polygonal container for dispensing a liquid is described herein. The container can include a flexible bladder, bag, and/or pouch having the liquid therein. The container provides support and/or containment for the liquid-containing bladder. The bladder includes an outlet spout or tap that can be inserted through an opening defined in a side wall of the container for dispensing the liquid from the bladder through the container. In a particular embodiment, the container is used to dispense a beverage, such as wine, coffee, tea, water, juice, and/or milk. Although the container described herein can have any suitable size and/or dimensions, in particular embodiments, the container is configured to contain 3 liters (L), 1.5 L, 1 L, 750 milliliters (mL), or 250 mL of liquid. Alternatively, the container is configured to contain 1 pint, 1 quart, 2 quarts, and/or 1 gallon of liquid. A method for constructing the container is also described herein.

The container is formed from a single sheet of material. The container may be constructed from a blank of sheet material using a machine. In one embodiment, the container is fabricated from a cardboard material and is configured to be an outer container housing an inner flexible container configured to retain a liquid within the outer container. The outer container, however, may be fabricated using any suitable material, and therefore is not limited to a specific type of material. In alternative embodiments, the outer container is fabricated using cardboard, plastic, fiberboard, paperboard, foamboard, corrugated paper, and/or any suitable material known to those skilled in the art and guided by the teachings herein provided. In particular embodiments, the outer container is formed from a non-liquid permeable material.

For purposes of this disclosure, the outer container will be referred to as the container or box, and the inner container will be referred to as the bag or bladder. The combination of the box and the bag will be referred to as a bag-in-box container. The embodiments shown herein include a six-sided, eight-sided, and twelve-sided, cylindrical shaped bag-in-box containers. Each of the containers shown herein has a height that is greater than the width or diameter of the box. For example, the height of the container is about one-time greater (1×) to about three-times (3×) greater than the width of the container, about one-and-a-half-times (1.5×) to about two-and-a-half-times (2.5×) greater than the width, and/or about two-times (2×) to about two-and-a-third-times (2.3×) greater than the width.

In other words, these embodiments are designed to closely resemble the shape of a typical wine bottle with a dispensing spout near the bottom of the box. Thus, the containers has a longitudinal axis that extends perpendicular to a horizontal surface when the bottom of the box is placed on the horizontal surface (i.e., in its dispensing position). However, it should be noted that these bag-in-box containers could also be configured such that the longitudinal axis extends parallel to the horizontal surface when placed on the horizontal surface in its dispensing position. In other words, in these alternative embodiments, the bag-in-box container could be sized and shaped to closely resemble a typical wine barrel having a dispensing spout on a top or bottom end of the barrel.

In an example embodiment, the container includes at least one marking thereon including, without limitation, indicia that communicates the product stored in the container, a manufacturer of the product, and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product, and/or a seller of the product.

The terms "upward," "top," and variations thereof refer to a direction or relative location along a height of the blank and/or container as illustrated in the figures; the terms "downward," "bottom," and variations thereof refer to a direction or relative location along the height of the blank and/or container as illustrated in the figures; and the terms "inward," "inner," and variations thereof refer to a direction or relative location from a free edge and/or a line of weakness toward a panel defined by the free edge and/or the line of weakness. Further, although each container is shown having respective height and width dimensions, the heights and/or the widths of each container described herein can be the same or vary among embodiments.

Referring now to the drawings, FIG. 1 is a top plan view of an example embodiment of a blank 10 of sheet material. An octagonal container 200 (shown in FIG. 2) is formed from blank 10. Blank 10 has a first or interior surface 12 and an opposing second or exterior surface 14. Further, blank 10 defines a leading edge 16 and an opposing trailing edge 18. In one embodiment, blank 10 includes, in series from leading edge 16 to trailing edge 18, a first corner panel 20, a rear panel 22, a second corner panel 24, a first side panel 26, a third corner panel 28, a front panel 30, a fourth corner panel 32, a second side panel 34, and a glue panel 36 coupled together along preformed, generally parallel, fold lines 38, 40, 42, 44, 46, 48, 50, and 52, respectively. Front panel 30 and rear panel 22 are also considered to be end panels. Container 200 formed from blank 10 may be referred to as beverage container, although it will be understood container 200 can be used to contain any suitable product(s).

First corner panel 20 extends from leading edge 16 to fold line 38, rear panel 22 extends from first corner panel 20 along fold line 38, second corner panel 24 extends from rear panel 22 along fold line 40, first side panel 26 extends from second corner panel 24 along fold line 42, third corner panel 28 extends from first side panel 26 along fold line 44, front panel 30 extends from third corner panel 28 along fold line 46, fourth corner panel 32 extends from front panel 30 along fold line 48, second side panel 34 extends from fourth corner panel 32 along fold line 50, and glue panel 36 extends from fold line 52 to trailing edge 18. Fold lines 38, 40, 42, 44, 46, 48, 50, and 52, as well as other fold lines and/or hinge lines described herein, may include any suitable line of weakening and/or line of separation known to those skilled in the art and guided by the teachings herein provided. In the exemplary embodiment, panels 20, 22, 24, 26, 28, 30, 32, and 34 each have approximately the same width, however, in particular embodiments, corner panels 20, 24, 28, and/or 32 may be wider or narrower than end panels 22 and 30 and/or side panels 26 and 34, end panels 22 and 30 may be wider or narrower than side panels 26 and 34, and/or panels 20, 22, 24, 26, 28, 30, 32, and/or 34 may have any suitable widths to form octagonal container 200. In the exemplary embodiment, a height $H_1$ of panels 20, 22, 24, 26, 28, 30, 32, and/or 34 is larger than a width of each panel 20, 22, 24, 26, 28, 30, 32, and 34.

Front panel 30 includes a removable spout cutout 54 and a removable flap 56. Spout cutout 54 is defined by a perforated line 58 and is positioned adjacent a bottom 60 of front panel 30. Spout cutout 54 is configured to correspond to an outlet (not shown) of an inner bladder (not shown) that is positioned within container 200. Alternatively, when blank 10 is formed from a liquid impermeable material, spout cutout 54 is configured to retain a spout (not shown) in flow communication with a cavity 220 (shown in FIG. 2) of container 200. In the exemplary embodiment, removable flap 56 is defined by perforated lines 62 and a top fold line 64 to enable removable flap 56 to be at least partially removed from front panel 30. Alternatively, removable flap 56 is defined by perforated lines that enable removable flap 56 to be completely detached from front panel 30. In the exemplary embodiment, removable flap 56 is configured to enable a user to access the bladder positioned within container 200 and to position the outlet of the bladder within spout cutout 54 when cutout 54 has been at least partially removed from front panel 30. Although perforated lines 62 are shown as being partially collinear with fold lines 46 and 48, perforated lines 62 may be at any suitable location with respect to front panel 30, third corner panel 28, fourth corner panel 32, fold line 46, and/or fold line 48.

First corner panel 20, second corner panel 24, third corner panel 28, fourth corner panel 32, and glue panel 36 each have a bottom edge 66 that is substantially collinear along a length of blank 10. Similarly, first corner panel 20, second corner panel 24, third corner panel 28, fourth corner panel 32, and glue panel 36 each have a top edge 68 that is substantially collinear along a length of blank 10, except for notches 70, 72, 74, and 76. More specifically, notch 70 is defined in top edge 68 of first corner panel 20 adjacent to fold line 38, notch 72 is defined in top edge 68 of second corner panel 24 adjacent fold line 40, notch 74 is defined in top edge 68 of third corner panel 28 adjacent fold line 46, and notch 76 is defined in top edge 68 of fourth corner panel 32 adjacent fold line 48. Notches 70, 72, 74, and 76 are configured to enable container 200 to be formed from blank 10.

A first bottom panel 78 extends from rear panel 22 along a fold line 80, and a second bottom panel 82 extends from front panel 30 along a fold line 84. Fold lines 80 and 84 are slightly offset downwardly from bottom edges 66 to enable container 200 to be formed from blank 10. A first bottom flap 86 extends from first side panel 26 along a fold line 88, and a second bottom flap 90 extends from second side panel 34 along a fold line 92. Fold lines 88 and 92 are offset upwardly from bottom edges 66 to enable container 200 to be formed from blank 10.

Bottom panels 78 and 82 are each substantially octagon-shaped and substantially congruent. More specifically, each bottom panel 78 and 82 includes a first corner edge 94, a first side edge 96, a second corner edge 98, a first end edge 100, a third corner edge 102, a second side edge 104, and a fourth corner edge 106. Edges 94, 96, 98, 100, 102, 104, and 106 are free edges and are sized to correspond to the widths of panels 20, 22, 24, 26, 28, 30, 32, 34, and/or 36. A second end edge of each bottom panel 78 or 82 is defined by fold line 80 or 84, respectively. In the exemplary embodiment, side edges 96 and/or 104 of each bottom panel 78 and 82 are slightly curved inwardly; however, it should be understood that side edges 96 and/or 104 can be substantially linear.

Bottom flaps 86 and 90 are substantially congruent and sized such that when container 200 is formed, free end edges 108 of each bottom flap 86 and 90 are in contact or adjacent, but do not overlap. Alternatively, free end edges 108 overlap or a gap is defined between free edges 108. In the exemplary embodiment, each bottom flap 86 and 90 also includes a first corner edge 110, a first side edge 112, a second corner edge 114, and a second side edge 116. Corner edges 110 and/or 114 may be shorter than corner edges 94, 98, 102, and/or 106, but are at the same angle to bottom edges 66 as corner edges 94 and 106 are. In the exemplary embodiment, side edges 112 and 116 of bottom flaps 86 and 90 are shaped to conform to edges 106 and 104 or edges 94 and 96 of bottom panels 78 and/or 82.

A first top panel 118 extends from rear panel 22 along a fold line 120, and a second top panel 122 extends from front panel 30 along a fold line 124. Fold lines 120 and 124 are slightly offset upwardly from top edges 68 to enable container 200 to be formed from blank 10. A first top flap 126 extends from first side panel 26 along a fold line 128, and a second top flap 130 extends from second side panel 34 along a fold line 132. Fold lines 128 and 132 are offset downwardly from top edges 68 to enable container 200 to be formed from blank 10.

Top panels 118 and 122 are each substantially octagon-shaped and substantially congruent. More specifically, each top panel 118 and 122 includes a first corner edge 134, a first side edge 136, a second corner edge 138, a first end edge 140, a third corner edge 142, a second side edge 144, and a fourth corner edge 146. Edges 134, 136, 138, 140, 142, 144, and 146 are free edges and are sized to correspond to the widths of panels 20, 22, 24, 26, 28, 30, 32, 34, and/or 36. A second end edge of each top panel 118 or 122 is defined by fold line 120 or 124, respectively. In the exemplary embodiment, side edges 136 and/or 144 of each top panel 118 and 122 are slightly curved inwardly; however, it should be understood that side edges 136 and/or 144 can be substantially linear. In the exemplary embodiment, first top panel 118 includes a handle cutout 148, and second top panel 122 includes a handle flap 150. Handle flap 150 is defined by a fold line 152 and a perforated line 154. Perforated line 154 is configured to enable handle flap 150 to be selectively folded into handle cutout 148 as described in more detail herein. In an alternative embodiment, perforated line 154 is a continuous cut line. Further, it should be understood that handle cutout 148 and handle flap 150 can be any suitable shape, including an oval. In an alternative embodiment, in which first top panel 118 forms the outermost surface of container 200, first top panel 118 includes handle flap 150 and second top panel 122 includes handle cutout 148.

Top flaps 126 and 130 are substantially congruent and sized such that when container 200 is formed, free end edges 156 of each top flap 126 and 130 are in contact or adjacent, but do not overlap. Alternatively, free end edges 156 overlap or a gap is defined between free edges 156. In the exemplary embodiment, each end edge 156 includes a handle cutout 158 that corresponds to a shape of handle cutout 148. More specifically, each handle cutout 158 is semi-oval in shape. Further, each top flap 126 and 130 includes a first corner edge 160, a first side edge 162, a second corner edge 164, and a second side edge 166. Corner edges 160 and/or 164 may be shorter than corner edges 134, 138, 142, and/or 146, but are at the same angle to top edges 68 as corner edges 134 and 146 are. In the exemplary embodiment, side edges 162 and 166 of top flaps 126 and 130 are shaped to conform to edges 134 and 136 or edges 144 and 146 of top panels 118 and/or 122.

Figure 2:
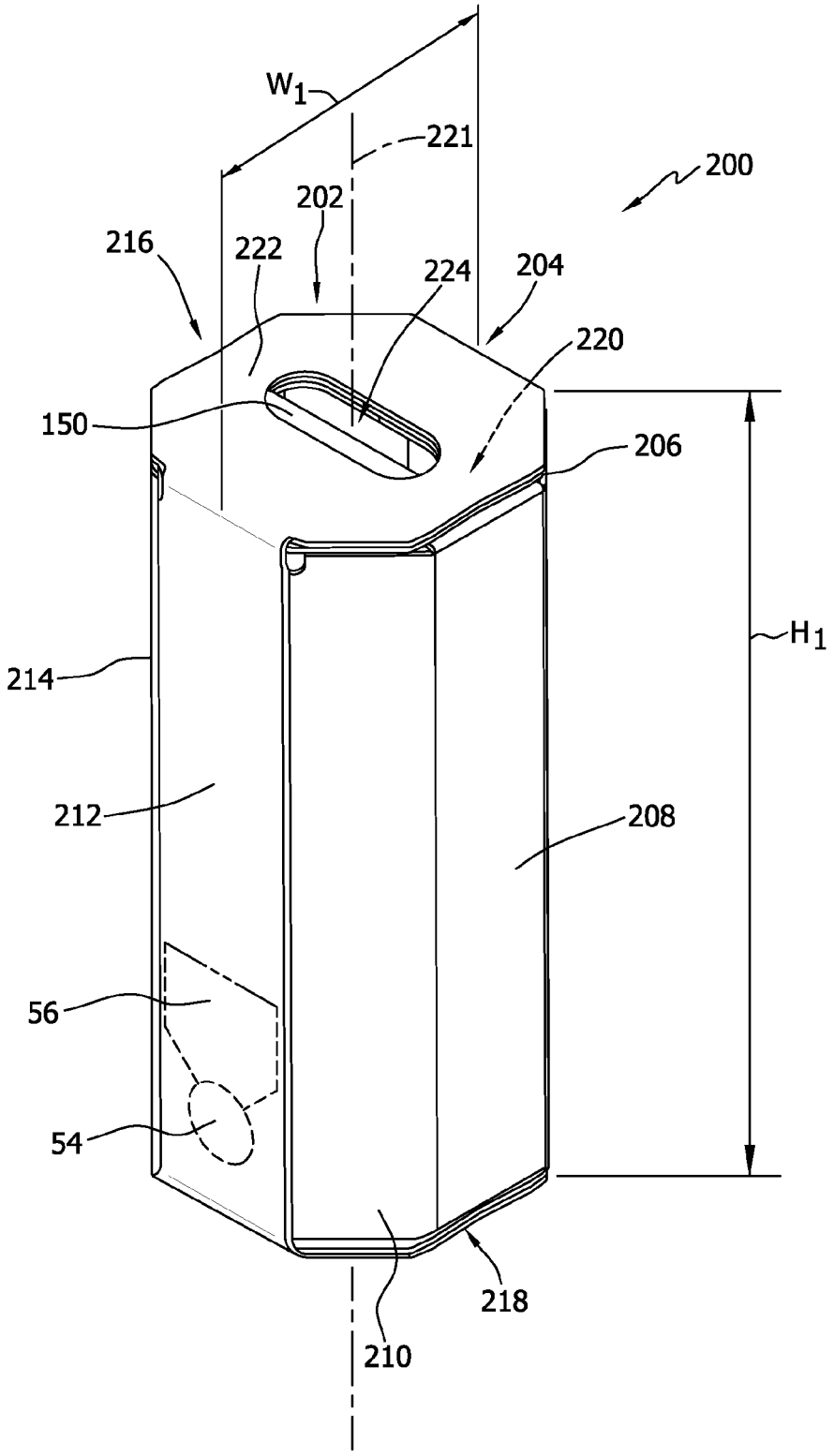

FIG. 2 is a perspective view of a container 200 formed from blank 10 (shown in FIG. 1). Referring to FIGS. 1 and 2, to construct container 200 from blank 10, first corner panel 20 is rotated about fold line 38 toward interior surface 12 of rear panel 22, rear panel 22 is rotated about fold line 40 toward interior surface 12 of second corner panel 24, second corner panel 24 is rotated about fold line 42 toward interior surface 12 of first side panel 26, first side panel 26 is rotated about fold line 44 toward interior surface 12 of third corner panel 28, third corner panel 28 is rotated about fold line 46 toward interior surface 12 of front panel 30, front panel 30 is rotated about fold line 48 toward interior surface 12 of fourth corner panel 32, fourth corner panel 32 is rotated about fold line 50 toward interior surface 12 of second side panel 34, and second side panel 34 is rotated about fold line 52 toward interior surface 12 of glue panel 36. Any suitable adhesive is applied to exterior surface 14 of glue panel 36 and/or interior surface 12 of first corner panel 20. Alternatively, adhesive is applied to interior surface 12 of glue panel 36 and/or exterior surface 14 of first corner panel 20. Glue panel 36 and first corner panel 20 are coupled together to form a first corner wall 202.

Rear panel 22 forms a rear wall or a first end wall 204, second corner panel 24 forms a second corner wall 206, first side panel 26 forms a first side wall 208, third corner panel 28 forms a third corner wall 210, front panel 30 forms a front wall or a second end wall 212, fourth corner panel 32 forms a fourth corner wall 214, and second side panel 34 forms a second side wall 216. First corner wall 202 and third corner wall 210 are substantially parallel, end walls 204 and 212 are substantially parallel, second corner wall 206 and fourth corner wall 214 are substantially parallel, and side walls 208 and 216 are substantially parallel.

First bottom flap 86 is rotated about fold line 88 to be substantially perpendicular to first side wall 208, and second bottom flap 90 is rotated about fold line 92 to be substantially perpendicular to second side wall 216. Any suitable adhesive is applied to exterior surfaces 14 of bottom flaps 86 and/or 90 and/or interior surface 12 of first bottom panel 78. Alternatively, adhesive is not applied to bottom flaps 86 and 90 and/or first bottom panel 78. In the exemplary embodiment, first bottom panel 78 is rotated about fold line 80 to be substantially perpendicular to rear wall 204 and in face-to-face relationship to bottom flaps 86 and 90. More specifically, interior surface 12 of first bottom panel 78 is directly adjacent to, and/or in contact with, exterior surface 14 of bottom flaps 86 and 90. Second bottom panel 82 is then rotated about fold line 84 to be substantially perpendicular to front wall 212 and in face-to-face relationship to first bottom panel 78. In the exemplary embodiment, any suitable adhesive is applied to exterior surface 14 of first bottom panel 78 and/or interior surface 12 of second bottom panel 82, and second bottom panel 82 is coupled to first bottom panel 78. As such, first bottom panel 78 is positioned between bottom flaps 86 and 90 and second bottom panel 82. Alternatively, second bottom panel 82 is positioned between bottom flaps 86 and 90 and first bottom panel 78. In the exemplary embodiment, bottom flaps 86 and 90, first bottom panel 78, and second bottom panel 82 form a bottom wall 218 of container.

Walls 202, 204, 206, 208, 210, 212, 214, 216, and 218 define cavity 220 of container 200. A longitudinal axis 221 of container 200 extends substantially parallel to walls 202, 204, 206, 208, 210, 212, 214, and 216 and substantially perpendicular to bottom wall 218. Walls 202, 204, 206, 208, 210, 212, 214, and 216 each have height $H_1$ that is measured substantially parallel to longitudinal axis 221. As such, container 200 has height $H_1$. Further, container 200 has a width $W_1$ measured substantially perpendicularly to longitudinal axis 221 between opposing walls 202 and 210, 204 and 212, 206 and 214, and/or 208 and 216. In the exemplary embodiment, height $H_1$ is about one-time (1×) to about three-times (3×) larger than width $W_1$.

A bladder (not shown) filled with a liquid, such as wine, is inserted into cavity 220 such that an outlet, such as a spout (not shown), of the bladder is adjacent spout cutout 54 and/or removable flap 56. Optionally, before the bladder is inserted into cavity 220, a sloped insert can be positioned adjacent bottom wall 218 to facilitate channeling liquid toward spout cutout 54. In a particular embodiment where container 200 is formed from a liquid impermeable material, a spout (not shown) is coupled to front wall 212 at spout cutout 54 and a liquid is directed into cavity 220.

To form a top wall 222 of container 200 and close container 200, first top flap 126 is rotated about fold line 128 to be substantially perpendicular to first side wall 208, and second top flap 130 is rotated about fold line 132 to be substantially perpendicular to second side wall 216. Any suitable adhesive is applied to exterior surfaces 14 of top flaps 126 and/or 130 and/or interior surface 12 of first top panel 118. Alternatively, adhesive is not applied to top flaps 126 and 130 and/or first top panel 118. In the exemplary embodiment, first top panel 118 is rotated about fold line 120 to be substantially perpendicular to rear wall 204 and in face-to-face relationship to top flaps 126 and 130. More specifically, interior surface 12 of first top panel 118 is directly adjacent to, and/or in contact with, exterior surface 14 of top flaps 126 and 130. Cutouts 158 and handle cutout 148 are substantially aligned with each other to define a top opening 224.

Second top panel 122 is then rotated about fold line 124 to be substantially perpendicular to front wall 212 and in face-to-face relationship to first top panel 118. Handle flap 150 is substantially aligned with top opening 224. In the exemplary embodiment, any suitable adhesive is applied to exterior surface 14 of first top panel 118 and/or interior surface 12 of second top panel 122, and second top panel 122 is coupled to first top panel 118. As such, first top panel 118 is positioned between top flaps 126 and 130 and second top panel 122. Alternatively, second top panel 122 is positioned between top flaps 126 and 130 and first top panel 118. In the exemplary embodiment, top flaps 126 and 130, first top panel 118, and second top panel 122 form top wall 222 of container 200. To facilitate carrying and/or transporting container 200, handle flap 150 may be pushed into top opening 224 by partially separating handle flap 150 from second top panel 122 at perforated line 154 and by rotating handle flap 150 into top opening 224 at fold line 152.

To dispense the liquid from the bladder within container 200, spout cutout 54 is at least partially removed from front wall 212 at perforated line 58. Optionally, removable flap 56 can be peeled back from spout cutout 54 upward to facilitate access to the outlet of the bladder. The user grasps the outlet of the bladder and positions the outlet of the bladder within spout cutout 54. Removable flap 56 can be re-positioned over the bladder to facilitate retaining the bladder within container 200.

The above-described method for forming container 200 from blank 10 can be performed manually and/or automatically. In the exemplary embodiment, at least walls 202, 204, 206, 208, 210, 212, 214, and 216 are formed automatically using a machine having a mandrel that is shaped to correspond to a cross-sectional shape of container 200.

Figure 3:
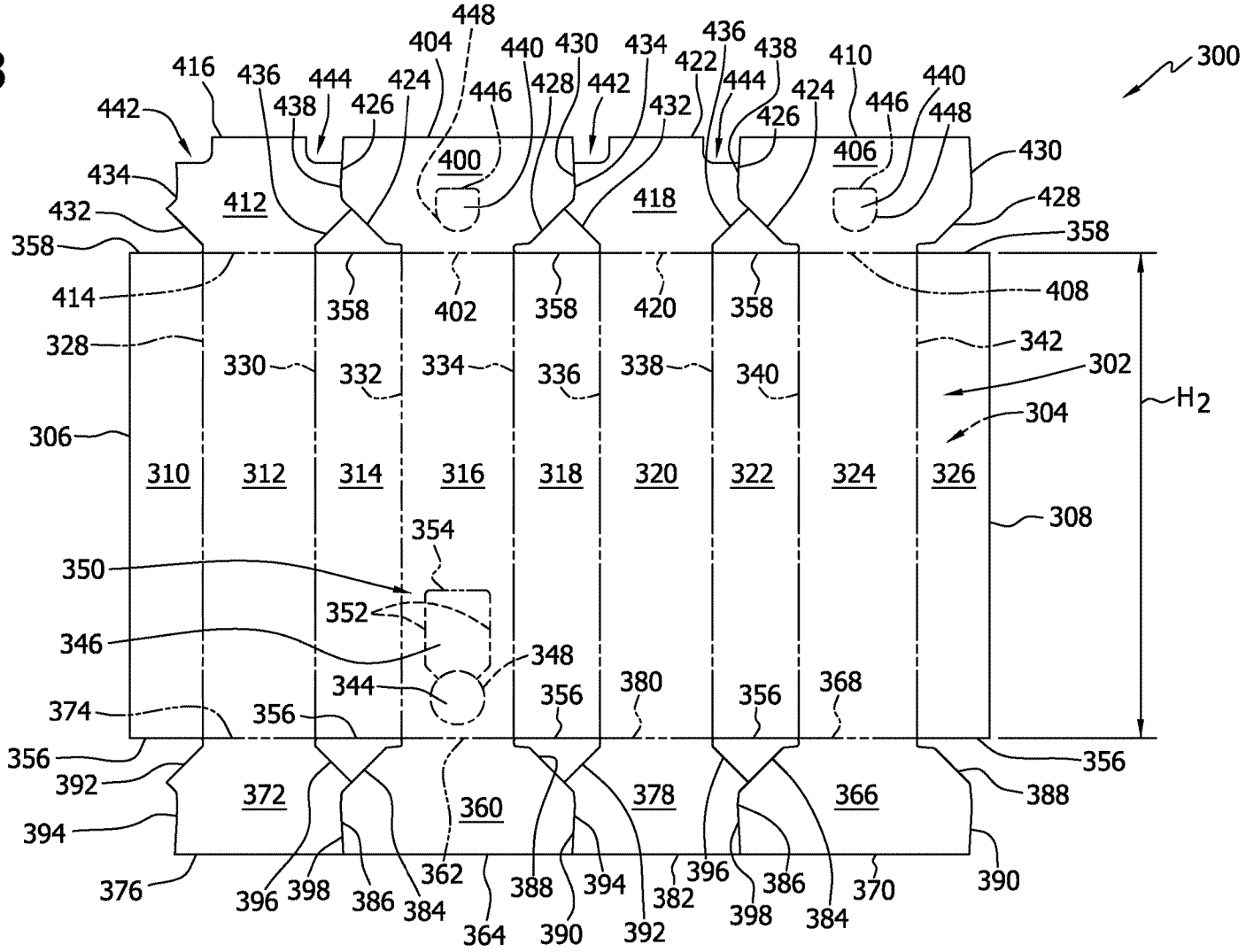

FIG. 3 is a top plan view of first alternative embodiment of a blank 300 of sheet material. An octagonal container 450 (shown in FIG. 4) is formed from blank 300. Blank 300 has a first or interior surface 302 and an opposing second or exterior surface 304. Further, blank 300 defines a leading edge 306 and an opposing trailing edge 308. In one embodiment, blank 300 includes, in series from leading edge 306 to trailing edge 308, a first corner panel 310, a first side panel 312, a second corner panel 314, a front panel 316, a third corner panel 318, a second side panel 320, a fourth corner panel 322, a rear panel 324, and a glue panel 326 coupled together along preformed, generally parallel, fold lines 328, 330, 332, 334, 336, 338, 340, and 342, respectively. Front panel 316 and rear panel 324 are also considered to be end panels. Container 450 formed from blank 300 may be referred to as beverage container, although it will be understood container 450 can be used to contain any suitable product(s).

First corner panel 310 extends from leading edge 306 to fold line 328, first side panel 312 extends from first corner panel 310 along fold line 330, second corner panel 314 extends from first side panel 312 along fold line 332, front panel 316 extends from second corner panel 314 along fold line 334, third corner panel 318 extends from front panel 316 along fold line 336, second side panel 320 extends from third corner panel 318 along fold line 338, fourth corner panel 322 extends from second side panel 320 along fold line 340, rear panel 324 extends from fourth corner panel 322 along fold line 342, and glue panel 326 extends from fold line 342 to trailing edge 308. Fold lines 328, 330, 332, 334, 336, 338, 340, and 342, as well as other fold lines and/or hinge lines described herein, may include any suitable line of weakening and/or line of separation known to those skilled in the art and guided by the teachings herein provided.

In the exemplary embodiment, corner panels 310, 314, 318, and 322 are narrower than side panels 312 and 320 and end panels 316 and 324, and side panels 312 and 320 are narrower than end panels 316 and 324. In alternative embodiments, panels 310, 312, 314, 316, 318, 320, 322, 324, and/or 326 each have approximately the same width, corner panels 310, 314, 318, and/or 322 may be wider or narrower than end panels 316 and 324 and/or side panels 312 and 320, end panels 316 and 324 may be wider or narrower than side panels 312 and 320, and/or panels 310, 312, 314, 316, 318, 320, 322, 324, and/or 326 may have any suitable widths to form octagonal container 450. In the exemplary embodiment, a height $H_2$ of panels 310, 312, 314, 316, 318, 320, 322, 324, and/or 326 is larger than a width of each panel 310, 312, 314, 316, 318, 320, 322, 324, and/or 326.

In the exemplary embodiment, front panel 316 includes a spout cutout 344 and a removable flap 346. Spout cutout 344 is defined by a perforated line 348 and is positioned adjacent a bottom 350 of front panel 316. Spout cutout 344 is configured to correspond to an outlet (not shown) of an inner bladder (not shown) that is positioned within container 450. Alternatively, when blank 300 is formed from a liquid impermeable material, spout cutout 344 is configured to retain a spout (not shown) in flow communication with a cavity 470 (shown in FIG. 4) of container 450. In the exemplary embodiment, removable flap 346 is at least partially defined by perforated lines 352 and a top fold line 354 to enable removable flap 346 to be at least partially removed from front panel 316. Alternatively, removable flap 346 is defined by perforated lines that enable removable flap 346 to be completely detached from front panel 316. In the exemplary embodiment, removable flap 346 is configured to enable a user to access the bladder positioned within container 450 and to position the outlet of the bladder within spout cutout 344 when cutout 344 has been at least partially removed from front panel 316. Although perforated lines 352 are shown as being within front panel 316, perforated lines 352 may be at any suitable location with respect to front panel 316, second corner panel 314, third corner panel 318, fold line 332, and/or fold line 334.

First corner panel 310, second corner panel 314, third corner panel 318, fourth corner panel 322, and glue panel 326 each have a bottom edge 356 that is substantially collinear along a length of blank 300. Similarly, first corner panel 310, second corner panel 314, third corner panel 318, fourth corner panel 322, and glue panel 326 each have a top edge 358 that is substantially collinear along the length of blank 300.

A first outer bottom panel 360 extends from front panel 316 along a fold line 362 to a free edge 364, and a second outer bottom panel 366 extends from rear panel 324 along a fold line 368 to a free edge 370. Fold lines 362 and 368 are generally collinear with bottom edges 356; however, fold line 362 and/or 368 may be offset from bottom edges 356. A first inner bottom flap 372 extends from first side panel 312 along a fold line 374 to a free edge 376, and a second inner bottom flap 378 extends from second side panel 320 along a fold line 380 to a free edge 382. Fold lines 374 and 380 are generally collinear with bottom edges 356 to enable container 450 to be formed from blank 300; however, fold line 374 and/or 380 may be offset from bottom edges 356. In the exemplary embodiment, free edges 364, 370, 376, and 382 are substantially collinear, and inner bottom flaps 372 and 378 and outer bottom panels 360 and 366 are sized to be in contact or adjacent at free edges 376 and 382 and free edges 364 and 370, respectively. Alternatively, outer bottom panels 360 and 366 and/or inner bottom flaps 372 and 378 are sized to overlap and/or to form a gap therebetween.

Outer bottom panels 360 and 366 are each substantially hemi-octagonal and substantially congruent. More specifically, each outer bottom panel 360 and 366 includes a first corner edge 384, a first partial side edge 386, a second corner edge 388, and a second partial side edge 390. Edges 384, 386, 388, and 390 are free edges and are sized to correspond to the widths of panels 310, 312, 314, 316, 318, 320, 322, 324, and/or 326. An end edge of each outer bottom panel 360 or 366 is defined by fold line 362 or 368, respectively. In the exemplary embodiment, side edges 386 and/or 390 of each outer bottom panel 360 and 366 are slightly curved inwardly; however, it should be understood that side edges 386 and/or 390 can be substantially linear. In an alternative embodiment, blank 300 includes bottom panels that are substantially similar to bottom panels 78 and 82 (shown in FIG. 1), rather than including outer bottom panels 360 and 366. In such an embodiment, blank 300 also includes bottom flaps that are substantially similar to bottom flaps 86 and 90 (shown in FIG. 1), rather than including inner bottom flaps 372 and 378.

In the exemplary embodiment, inner bottom flaps 372 and 378 are substantially congruent, and each inner bottom flap 372 and 378 includes a first corner edge 392, a first side edge 394, a second corner edge 396, and a second side edge 398. Corner edges 392 and/or 396 may be shorter than corner edges 384 and/or 388, but are at the same angle to bottom edges 356 as corner edges 384 and 388 are. Further, side edges 394 and 398 of inner bottom flaps 372 and 378 are shaped to conform to edges 384 and 386 or edges 388 and 390 of outer bottom panels 360 and/or 366.

A first outer top panel 400 extends from front panel 316 along a fold line 402 to a free edge 404, and a second outer top panel 406 extends from rear panel 324 along a fold line 408 to a free edge 410. Fold lines 402 and 408 are generally collinear with top edges 358; however, fold line 402 and/or 408 may be offset from top edges 358. A first inner top flap 412 extends from first side panel 312 along a fold line 414 to a free edge 416, and a second inner top flap 418 extends from second side panel 320 along a fold line 420 to a free edge 422. Fold lines 414 and 420 are generally collinear with top edges 358 to enable container 450 to be formed from blank 300; however, fold line 414 and/or 420 may be offset from top edges 358. In the exemplary embodiment, free edges 404, 410, 416, and 422 are substantially collinear, and inner top flaps 412 and 418 and outer top panels 400 and 406 are sized to be in contact or adjacent at free edges 416 and 422 and free edges 404 and 410, respectively. Alternatively, outer top panels 400 and 406 and/or inner top flaps 412 and 418 are sized to overlap and/or to form a gap therebetween.

Outer top panels 400 and 406 are each substantially hemi-octagonal and substantially congruent. More specifically, each outer top panel 400 and 406 includes a first corner edge 424, a first partial side edge 426, a second corner edge 428, and a second partial side edge 430. Edges 424, 426, 428, and 430 are free edges and are sized to correspond to the widths of panels 310, 312, 314, 316, 318, 320, 322, 324, and/or 326. An end edge of each outer top panel 400 or 406 is defined by fold line 402 or 408, respectively. In the exemplary embodiment, side edges 426 and/or 430 of each outer top panel 400 and 406 are slightly curved inwardly; however, it should be understood that side edges 426 and/or 430 can be substantially linear. In an alternative embodiment, blank 300 includes top panels that are substantially similar to top panels 118 and 122 (shown in FIG. 1), rather than including outer top panels 400 and 406. In such an embodiment, blank 300 also includes top flaps that are substantially similar to top flaps 126 and 130 (shown in FIG. 1), rather than including inner top flaps 412 and 418.

In the exemplary embodiment, inner top flaps 412 and 418 are substantially congruent, and each inner top flap 412 and 418 includes a first corner edge 432, a first side edge 434, a second corner edge 436, and a second side edge 438. Corner edges 432 and/or 436 may be shorter than corner edges 424 and/or 428, but are at the same angle to top edges 358 as corner edges 424 and/or 428 are. Further, side edges 434 and 438 of inner top flaps 412 and 418 are shaped to conform to edges 424 and 426 or edges 428 and 430 of outer top panels 400 and/or 406.

In the exemplary embodiment, each outer top panel 400 and 406 includes semi-circular handle flap 440, and each inner top flap 412 and 418 includes a pair of partially rectangular handle cutouts 442 and 444. Handle flap 440 is defined by a fold line 446 and a perforated line 448 to enable handle flap 440 to be at least partially removed from top panel 400 and/or 406. In an alternative embodiment, perforated line 448 is a cut line. In the exemplary embodiment, perforated line 448 enables handle flap 440 to be selectively folded into handle cutouts 442 and 444 as described in more detail herein. Handle cutout 442 is defined in side edge 434 and free edge 416, and handle cutout 444 is defined in side edge 438 and free edge 416. Further, it should be understood that handle cutouts 442 and 444 and handle flap 440 can be any suitable shape, including semi-circular and/or rectangular.

Figure 4:
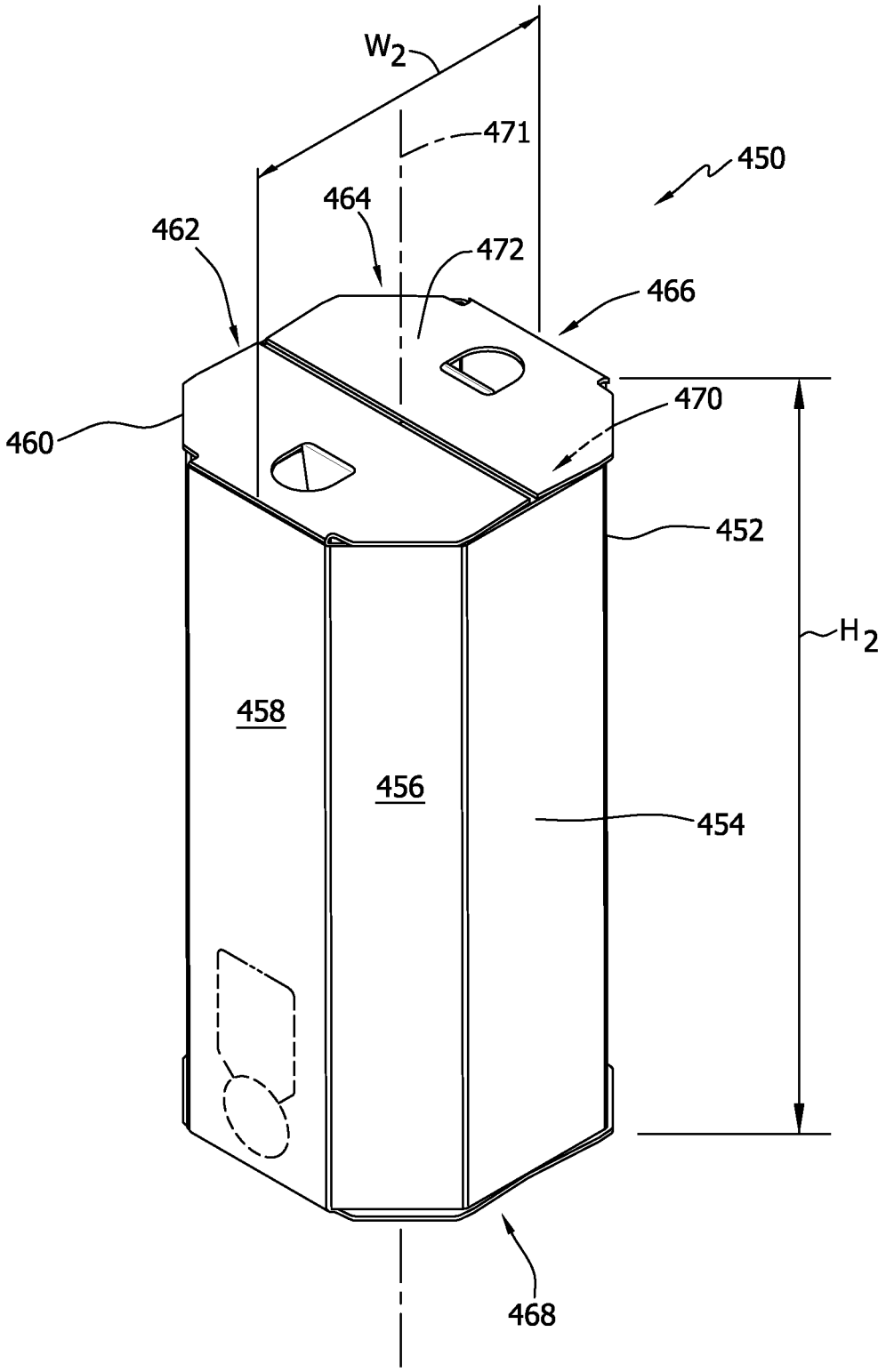

FIG. 4 is a perspective view of a container 450 formed from blank 300 (shown in FIG. 3). Referring to FIGS. 3 and 4, to construct container 450 from blank 300, first corner panel 310 is rotated about fold line 328 toward interior surface 302 of first side panel 312, first side panel 312 is rotated about fold line 330 toward interior surface 302 of second corner panel 314, second corner panel 314 is rotated about fold line 332 toward interior surface 302 of front panel 316, front panel 316 is rotated about fold line 334 toward interior surface 302 of third corner panel 318, third corner panel 318 is rotated about fold line 336 toward interior surface 302 of second side panel 320, second side panel 320 is rotated about fold line 338 toward interior surface 302 of fourth corner panel 322, fourth corner panel 322 is rotated about fold line 340 toward interior surface 302 of rear panel 324, and rear panel 324 is rotated about fold line 342 toward interior surface 302 of glue panel 326. Any suitable adhesive is applied to exterior surface 304 of glue panel 326 and/or interior surface 302 of first corner panel 310. Alternatively, adhesive is applied to interior surface 302 of glue panel 326 and/or exterior surface 304 of first corner panel 310. Glue panel 326 and first corner panel 310 are coupled together to form a first corner wall 452.

First side panel 312 forms a first side wall 454, second corner panel 314 forms a second corner wall 456, front panel 316 forms a front wall or a first end wall 458, third corner panel 318 forms a third corner wall 460, second side panel 320 forms a second side wall 462, fourth corner panel 322 forms a fourth corner wall 464, and rear panel 324 forms a rear wall or a second end wall 466. First corner wall 452 and third corner wall 460 are substantially parallel, end walls 458 and 466 are substantially parallel, second corner wall 456 and fourth corner wall 464 are substantially parallel, and side walls 454 and 462 are substantially parallel.

First inner bottom flap 372 is rotated about fold line 374 to be substantially perpendicular to first side wall 454, and second inner bottom flap 378 is rotated about fold line 380 to be substantially perpendicular to second side wall 462. Any suitable adhesive is applied to exterior surfaces 304 of inner bottom flaps 372 and/or 378 and/or interior surface 302 of outer bottom panels 360 and/or 366. First outer bottom panel 360 is rotated about fold line 362 to be substantially perpendicular to front wall 458 and coupled in face-to-face contact with inner bottom flaps 372 and 378. More specifically, interior surface 302 of first outer bottom panel 360 is in contact with or adjacent to exterior surface 304 of inner bottom flaps 372 and 378. Second outer bottom panel 366 is rotated about fold line 368 to be substantially perpendicular to rear wall 466 and coupled in face-to-face contact with inner bottom flaps 372 and 378. In the exemplary embodiment, inner bottom flaps 372 and 378 and outer bottom panels 360 and 366 form a bottom wall 468 of container 450.

Walls 452, 454, 456, 458, 460, 462, 466, and 468 define cavity 470 of container 450. A longitudinal axis 471 of container 450 extends substantially parallel to walls 452, 454, 456, 458, 460, 462, and 466 and substantially perpendicular to bottom wall 468. Walls 452, 454, 456, 458, 460, 462, and 466 each have height $H_2$ that is measured substantially parallel to longitudinal axis 471. As such, container 450 has height $H_2$. Further, container 450 has a width $W_2$ measured substantially perpendicularly to longitudinal axis 471 between opposing walls 452 and 460, 454 and 462, 456 and 464, and/or 458 and 466. In the exemplary embodiment, height $H_2$ is about one-time (1×) to about three-times (3×) larger than width $W_2$.

A bladder (not shown) filled with a liquid, such as wine, is inserted into cavity 470 such that an outlet, such as a spout (not shown), of the bladder is adjacent spout cutout 344 and/or removable flap 346. Optionally, before the bladder is inserted into cavity 470, a sloped insert can be positioned adjacent bottom wall 468 to facilitate channeling liquid toward spout cutout 344. In a particular embodiment where container 450 is formed from a liquid impermeable material, a spout (not shown) is coupled to front wall 458 at spout cutout 344 and a liquid is directed into cavity 470.

To form a top wall 472 of container 450 and close container 450, first inner top flap 412 is rotated about fold line 414 to be substantially perpendicular to first side wall 454, and second inner top flap 418 is rotated about fold line 420 to be substantially perpendicular to second side wall 462. Any suitable adhesive is applied to exterior surfaces 304 of inner top flaps 412 and/or 418 and/or interior surface 302 of outer top panels 400 and/or 406. First outer top panel 400 is rotated about fold line 402 to be substantially perpendicular to front wall 458 and coupled in face-to-face contact with inner top flaps 412 and 418. More specifically, interior surface 302 of first outer top panel 400 is in contact with or adjacent to exterior surface 304 of inner top flaps 412 and 418. Handle cutout 444 of first inner top flap 412, handle cutout 442 of second inner top flap 418, and handle flap 440 of first outer top panel 400 are substantially aligned with each other.

Second outer top panel 406 is then rotated about fold line 408 to be substantially perpendicular to rear wall 466 and coupled in face-to-face contact with inner top flaps 412 and 418. Interior surface 302 of second outer top panel 406 is in contact with or adjacent to exterior surface 304 of inner top flaps 412 and 418. Handle cutout 442 of first inner top flap 412, handle cutout 444 of second inner top flap 418, and handle flap 440 of second outer top panel 406 are substantially aligned with each other. To facilitate carrying and/or transporting container 450, flaps 440 may be pushed into handle cutouts 442 and 444 by at least partially separating flaps 440 from outer top panel 400 and/or 406 at perforated line 448 and by rotating flaps 440 into handle cutouts 442 and 444 at fold line 446.

To dispense the liquid from the bladder within container 450, spout cutout 344 is at least partially removed from front wall 458 at perforated line 348. Optionally, removable flap 346 can be peeled back from spout cutout 344 upward to facilitate access to the outlet of the bladder. The user grasps the outlet of the bladder and positions the outlet of the bladder within the spout cutout 344. Removable flap 346 can be re-positioned over the bladder to facilitate retaining the bladder within container 450.

The above-described method for forming container 450 from blank 300 can be performed manually and/or automatically. In the exemplary embodiment, at least walls 452, 454, 456, 458, 460, 462, 464, and 466 are formed automatically using a machine having a mandrel that is shaped to correspond to a cross-sectional shape of container 450.

Figure 5:
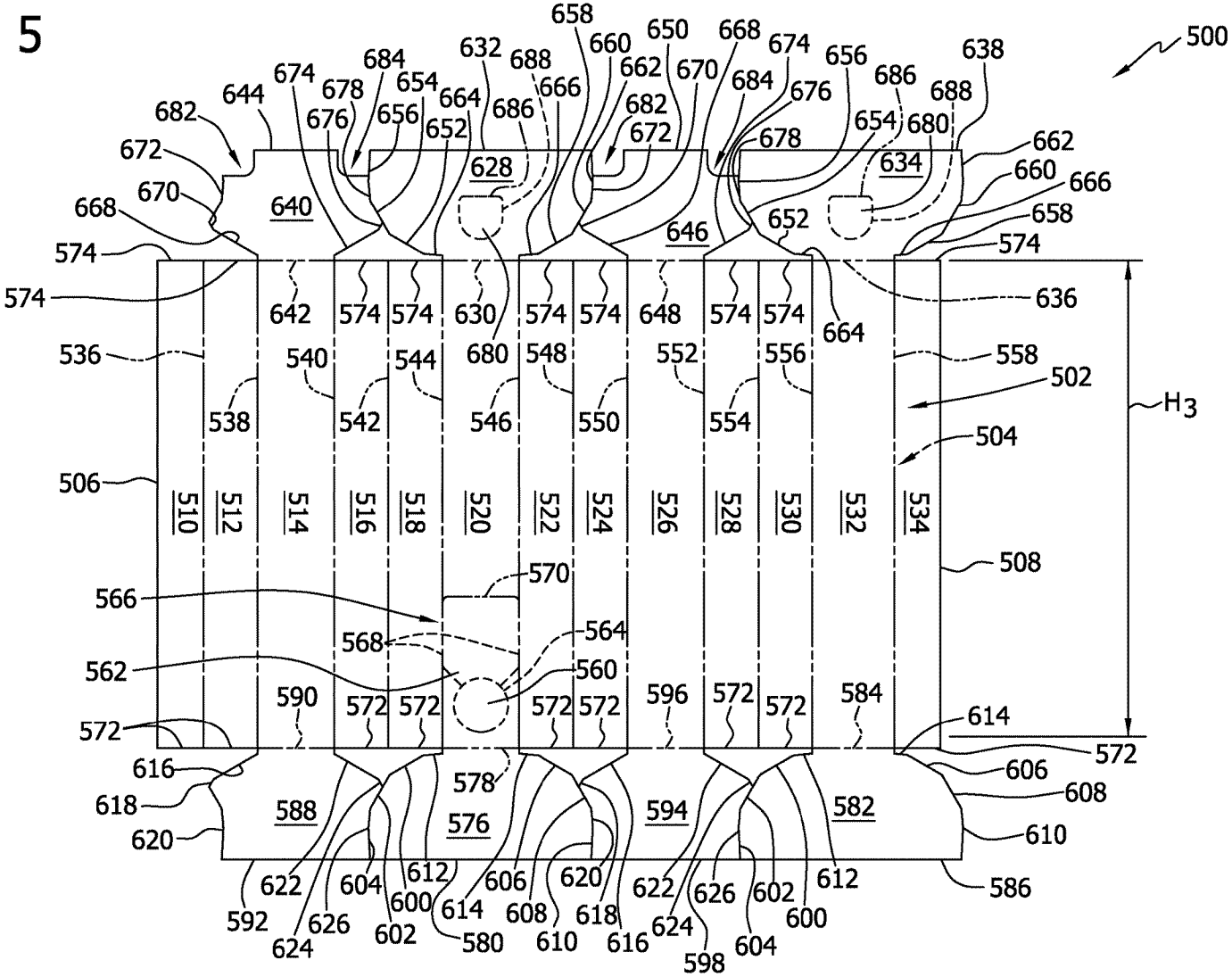

FIG. 5 is a top plan view of first alternative embodiment of a blank 500 of sheet material. A dodecagonal container 700 (shown in FIG. 6), a container having 12-sides, is formed from blank 500. Blank 500 has a first or interior surface 502 and an opposing second or exterior surface 504. Further, blank 500 defines a leading edge 506 and an opposing trailing edge 508. In one embodiment, blank 500 includes, in series from leading edge 506 to trailing edge 508, a first corner panel 510, a second corner panel 512, a first side panel 514, a third corner panel 516, a fourth corner panel 518, a front panel 520, a fifth corner panel 522, a sixth corner panel 524, a second side panel 526, a seventh corner panel 528, an eighth corner panel 530, a rear panel 532, and a glue panel 534 coupled together along preformed, generally parallel, fold lines 536, 538, 540, 542, 544, 546, 548, 550, 552, 554, 556, and 558, respectively. Front panel 520 and rear panel 532 can be considered end panels. Container 700 formed from blank 500 may be referred to as beverage container, although it will be understood container 700 can be used to contain any suitable product(s).

First corner panel 510 extends from leading edge 506 to fold line 536, second corner panel 512 extends from first corner panel 510 along fold line 536, first side panel 514 extends from second corner panel 512 along fold line 538, third corner panel 516 extends from first side panel 514 along fold line 540, fourth corner panel 518 extends from third corner panel 516 along fold line 542, front panel 520 extends from fourth corner panel 518 along fold line 544, fifth corner panel 522 extends from front panel 520 along fold line 546, sixth corner panel 524 extends from fifth corner panel 522 along fold line 548, second side panel 526 extends from sixth corner panel 524 along fold line 550, seventh corner panel 528 extends from second side panel 526 along fold line 552, eighth corner panel 530 extends from seventh corner panel 528 along fold line 554, rear panel 532 extends from eighth corner panel 530 along fold line 556, and glue panel 534 extends from fold line 558 to trailing edge 508. Fold lines 536, 538, 540, 542, 544, 546, 548, 550, 552, 554, 556, and 558, as well as other fold lines and/or hinge lines described herein, may include any suitable line of weakening and/or line of separation known to those skilled in the art and guided by the teachings herein provided.

In the exemplary embodiment, corner panels 510, 512, 516, 518, 522, 524, 528, and 530 are narrower than end panels 520 and 532 and side panels 514 and 526, and rear panel 532 is wider than front panel 520 and side panels 514 and 526. In alternative embodiments, panels 510, 512, 514, 516, 518, 520, 522, 524, 526, 528, 530, 532, and/or 534 each have approximately the same width, however, in particular embodiments, corner panels 510, 512, 516, 518, 522, 524, 528, and/or 530 may be wider or narrower than end panels 520 and 532 and/or side panels 514 and 526, end panels 520 and 532 may be wider or narrower than side panels 514 and 526, and/or panels 510, 512, 514, 516, 518, 520, 522, 524, 526, 528, 530, 532, and/or 534 may have any suitable widths to form dodecagonal container 700. In the exemplary embodiment, a height $H_3$ of panels 510, 512, 514, 516, 518, 520, 522, 524, 526, 528, 530, 532, and/or 534 is larger than a width of each panel 510, 512, 514, 516, 518, 520, 522, 524, 526, 528, 530, 532, and/or 534.

In the exemplary embodiment, front panel 520 includes a spout cutout 560 and a removable flap 562. Spout cutout 560 is defined by a perforated line 564 and is positioned adjacent a bottom 566 of front panel 520. Spout cutout 560 is configured to correspond to an outlet (not shown) of an inner bladder (not shown) that is positioned within container 700. Alternatively, when blank 500 is formed from a liquid impermeable material, spout cutout 560 is configured to retain a spout (not shown) in flow communication with a cavity 728 (shown in FIG. 6) of container 700. In the exemplary embodiment, removable flap 562 is defined by perforated lines 568 and a top fold line 570 to enable removable flap 562 to be at least partially removed from front panel 520. Alternatively, removable flap 562 is defined by perforated lines that enable removable flap 562 to be completely detached from front panel 520. In the exemplary embodiment, removable flap 562 is configured to enable a user to access the bladder positioned within container 700 and to position the outlet of the bladder within spout cutout 560 when cutout 560 has been at least partially removed from front panel 520. Although perforated lines 568 are shown as being collinear with fold lines 544 and 546, perforated lines 568 may be at any suitable location with respect to front panel 520, fourth corner panel 518, fifth corner panel 522, fold line 544, and/or fold line 546.

Corner panels 510, 512, 516, 518, 522, 524, 528, and 530 and glue panel 534 each have a bottom edge 572 that is substantially collinear along a length of blank 500. Similarly, each corner panel 510, 512, 516, 518, 522, 524, 528, and 530 and glue panel 534 has a top edge 574 that is substantially collinear along the length of blank 500.

A first outer bottom panel 576 extends from front panel 520 along a fold line 578 to a free edge 580, and a second outer bottom panel 582 extends from rear panel 532 along a fold line 584 to a free edge 586. Fold lines 578 and 584 are generally collinear with bottom edges 572; however, fold line 578 and/or 584 may be offset from bottom edges 572. A first inner bottom flap 588 extends from first side panel 514 along a fold line 590 to a free edge 592, and a second inner bottom flap 594 extends from second side panel 526 along a fold line 596 to a free edge 598. Fold lines 590 and 596 are generally collinear with bottom edges 572 to enable container 700 to be formed from blank 500; however, fold line 590 and/or 596 may be offset from bottom edges 572. In the exemplary embodiment, free edges 580, 586, 592, and 598 are substantially collinear, and inner bottom flaps 588 and 594 and outer bottom panels 576 and 582 are sized to be in contact or adjacent at free edges 592 and 598 and free edges 580 and 586, respectively. Alternatively, outer bottom panels 576 and 582 and/or inner bottom flaps 588 and 594 are sized to overlap and/or to form a gap therebetween.

Outer bottom panels 576 and 582 are each substantially hemi-dodecagonal and substantially congruent. More specifically, each outer bottom panel 576 and 582 includes a first corner edge 600, a second corner edge 602, a first partial side edge 604, a third corner edge 606, a fourth corner edge 608, and a second partial side edge 610. Edges 600, 602, 604, 606, 608, and 610 are free edges and are sized to correspond to the widths of panels 510, 512, 514, 516, 518, 520, 522, 524, 526, 528, 530, 532, and/or 534. An end edge of each outer bottom panel 576 or 582 is defined by free edges 612 and 614 and fold line 578 or 584, respectively. In the exemplary embodiment, side edges 604 and/or 610 of each outer bottom panel 576 and 582 are slightly curved inwardly; however, it should be understood that side edges 604 and/or 610 can be substantially linear. In an alternative embodiment, blank 500 includes bottom panels that are substantially similar to bottom panels 78 and 82 (shown in FIG. 1), rather than including outer bottom panels 576 and 582. In such an embodiment, blank 500 also includes bottom flaps that are substantially similar to bottom flaps 86 and 90 (shown in FIG. 1), rather than including inner bottom flaps 588 and 594.

In the exemplary embodiment, inner bottom flaps 588 and 594 are substantially congruent, and each inner bottom flap 588 and 594 includes a first corner edge 616, a first partial corner edge 618, a first side edge 620, a second corner edge 622, a second partial corner edge 624, and a second side edge 626. Further, side edges 620 and 626 of inner bottom flaps 588 and 594 are shaped to conform to edges 602 and 604 or edges 608 and 610 of outer bottom panels 576 and/or 582.

A first outer top panel 628 extends from front panel 520 along a fold line 630 to a free edge 632, and a second outer top panel 634 extends from rear panel 532 along a fold line 636 to a free edge 638. Fold lines 630 and 636 are generally collinear with top edges 574; however, fold line 630 and/or 636 may be offset from top edges 574. A first inner top flap 640 extends from first side panel 514 along a fold line 642 to a free edge 644, and a second inner top flap 646 extends from second side panel 526 along a fold line 648 to a free edge 650. Fold lines 642 and 648 are generally collinear with top edges 574 to enable container 700 to be formed from blank 500; however, fold line 642 and/or 648 may be offset from top edges 574. In the exemplary embodiment, free edges 632, 638, 644, and 650 are substantially collinear, and inner top flaps 640 and 646 and outer top panels 628 and 634 are sized to be in contact or adjacent at free edges 644 and 650 and free edges 632 and 638, respectively. Alternatively, outer top panels 628 and 634 and/or inner top flaps 640 and 646 are sized to overlap and/or to form a gap therebetween.

Outer top panels 628 and 634 are each substantially hemi-dodecagonal and substantially congruent. More specifically, each outer top panel 628 and 634 includes a first corner edge 652, a second corner edge 654, a first partial side edge 656, a third corner edge 658, a fourth corner edge 660, and a second partial side edge 662. Edges 652, 654, 656, 658, 660, and 662 are free edges and are sized to correspond to the widths of panels 510, 512, 514, 516, 518, 520, 522, 524, 526, 528, 530, 532, and/or 534. An end edge of each outer top panel 628 or 634 is defined by free edges 664 and 666 and fold line 630 or 636, respectively. In the exemplary embodiment, side edges 656 and/or 662 of each outer top panel 628 and 634 are slightly curved inwardly; however, it should be understood that side edges 656 and/or 662 can be substantially linear. In an alternative embodiment, blank 500 includes top panels that are substantially similar to top panels 118 and 122 (shown in FIG. 1), rather than including outer top panels 628 and 634. In such an embodiment, blank 500 also includes top flaps that are substantially similar to top flaps 126 and 130 (shown in FIG. 1), rather than including inner top flaps 640 and 646.

In the exemplary embodiment, inner top flaps 640 and 646 are substantially congruent, and each inner top flap 640 and 646 includes a first corner edge 668, a first partial corner edge 670, a first side edge 672, a second corner edge 674, a second partial corner edge 676, and a second side edge 678. Further, side edges 672 and 678 of inner top flaps 640 and 646 are shaped to conform to edges 654 and 656 or edges 660 and 662 of outer top panels 628 and/or 634.

In the exemplary embodiment, each outer top panel 628 and 634 includes semi-circular handle flap 680, and each inner top flap 640 and 646 includes a pair of partially rectangular handle cutouts 682 and 684. Handle flap 680 is defined by a fold line 686 and a perforated line 688 to enable handle flap 680 to be at least partially removed from top panel 628 and/or 634. In an alternative embodiment, perforated line 688 is a cut line. In the exemplary embodiment, perforated line 688 enables handle flap 680 to be selectively folded into handle cutouts 682 and 684 as described in more detail herein. Handle cutout 682 is defined in side edge 672 and free edge 644, and handle cutout 684 is defined in side edge 678 and free edge 644. Further, it should be understood that handle cutouts 682 and 684 and handle flap 680 can be any suitable shape, including semi-circular and/or rectangular.

Figure 6:
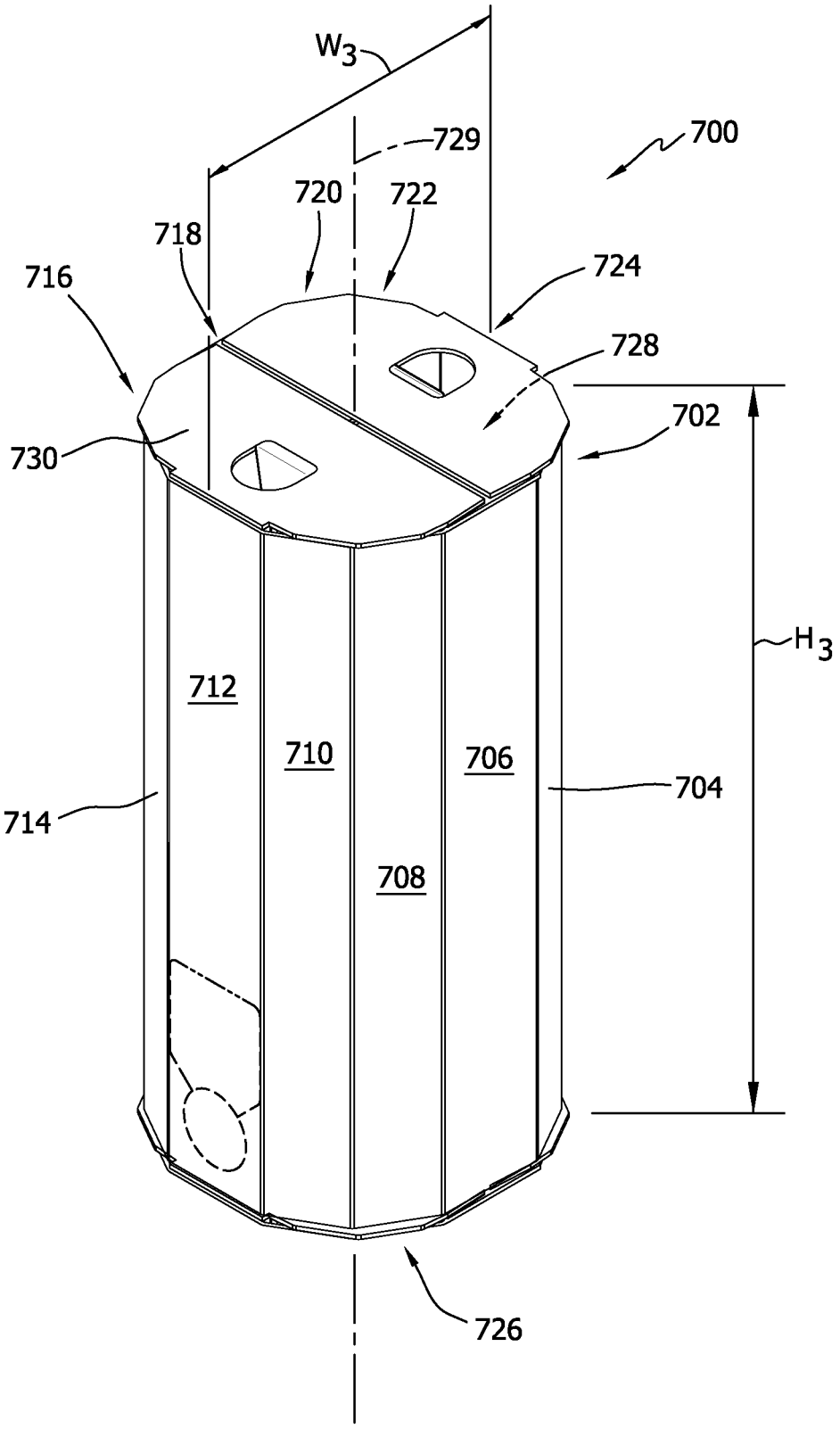

FIG. 6 is a perspective view of a container 700 formed from blank 500 (shown in FIG. 5). Referring to FIGS. 5 and 6, to construct container 700 from blank 500, first corner panel 510 is rotated about fold line 536 toward interior surface 502 of second corner panel 512, second corner panel 512 is rotated about fold line 538 toward interior surface 502 of first side panel 514, first side panel 514 is rotated about fold line 540 toward interior surface 502 of third corner panel 516, third corner panel 516 is rotated about fold line 542 toward interior surface 502 of fourth corner panel 518, fourth corner panel 518 is rotated about fold line 544 toward interior surface 502 of front panel 520, front panel 520 is rotated about fold line 546 toward interior surface 502 of fifth corner panel 522, fifth corner panel 522 is rotated about fold line 548 toward interior surface 502 of sixth corner panel 524, sixth corner panel 524 is rotated about fold line 550 toward interior surface 502 of second side panel 526, second side panel 526 is rotated about fold line 552 toward interior surface 502 of seventh corner panel 528, seventh corner panel 528 is rotated about fold line 554 toward interior surface 502 of eighth corner panel 530, eighth corner panel 530 is rotated about fold line 556 toward interior surface 502 of rear panel 532, and rear panel 532 is rotated about fold line 558 toward interior surface 502 of glue panel 534. Any suitable adhesive is applied to exterior surface 504 of glue panel 534 and/or interior surface 502 of first corner panel 510. Alternatively, adhesive is applied to interior surface 502 of glue panel 534 and/or exterior surface 504 of first corner panel 510. Glue panel 534 and first corner panel 510 are coupled together to form a first corner wall 702.

Second corner panel 512 forms a second corner wall 704, first side panel 514 forms a first side wall 706, third corner panel 516 forms a third corner wall 708, fourth corner panel 518 forms a fourth corner wall 710, front panel 520 forms a front wall or a first end wall 712, fifth corner panel 522 forms a fifth corner wall 714, sixth corner panel 524 forms a sixth corner wall 716, second side panel 526 forms a second side wall 718, seventh corner panel 528 forms a seventh corner wall 720, eighth corner panel 530 forms an eighth corner wall 722, and rear panel 532 forms a rear wall or a second end wall 724. First corner wall 702 and fifth corner wall 714 are substantially parallel, second corner wall 704 and sixth corner wall 716 are substantially parallel, third corner wall 708 and seventh corner wall 720 are substantially parallel, fourth corner wall 710 and eighth corner wall 722 are substantially parallel, end walls 712 and 724 are substantially parallel, and side walls 706 and 718 are substantially parallel.

First inner bottom flap 588 is rotated about fold line 590 to be substantially perpendicular to first side wall 706, and second inner bottom flap 594 is rotated about fold line 596 to be substantially perpendicular to second side wall 718. Any suitable adhesive is applied to exterior surfaces 504 of inner bottom flaps 588 and/or 594 and/or interior surface 502 of outer bottom panels 576 and/or 582. First outer bottom panel 576 is rotated about fold line 578 to be substantially perpendicular to front wall 712 and in face-to-face contact with, and coupled to, inner bottom flaps 588 and 594. More specifically, interior surface 502 of first outer bottom panel 576 is in contact with or adjacent to exterior surface 504 of inner bottom flaps 588 and 594. Second outer bottom panel 582 is rotated about fold line 584 to be substantially perpendicular to rear wall 724 and in face-to-face contact with, and coupled to, inner bottom flaps 588 and 594. In the exemplary embodiment, inner bottom flaps 588 and 594 and outer bottom panels 576 and 582 form a bottom wall 726 of container 700.

Walls 702, 704, 706, 708, 710, 712, 714, 716, 718, 720, 722, 724, and 726 define cavity 728 of container 700. A longitudinal axis 729 of container 700 extends substantially parallel to walls 702, 704, 706, 708, 710, 712, 714, 716, 718, 720, 722, and 724 and substantially perpendicular to bottom wall 726. Walls 702, 704, 706, 708, 710, 712, 714, 716, 718, 720, 722, and 724 each have height $H_3$ that is measured substantially parallel to longitudinal axis 729. As such, container 700 has height $H_3$. Further, container 700 has a width $W_3$ measured substantially perpendicularly to longitudinal axis 729 between opposing walls 702 and 714, 704 and 716, 706 and 718, 708 and 720, 710 and 722, and/or 712 and 724. In the exemplary embodiment, height $H_3$ is about one-time (1×) to about three-times (3×) larger than width $W_3$.

A bladder (not shown) filled with a liquid, such as wine, is inserted into cavity 728 such that an outlet, such as a spout (not shown), of the bladder is adjacent spout cutout 560 and/or removable flap 562. Optionally, before the bladder is inserted into cavity 728, a sloped insert can be positioned adjacent bottom wall 726 to facilitate channeling liquid toward spout cutout 560. In a particular embodiment where container 700 is formed from a liquid impermeable material, a spout (not shown) is coupled to front wall 712 at spout cutout 560 and a liquid is directed into cavity 728.

To form a top wall 730 of container 700 and close container 700, first inner top flap 640 is rotated about fold line 642 to be substantially perpendicular to first side wall 706, and second inner top flap 646 is rotated about fold line 648 to be substantially perpendicular to second side wall 718. Any suitable adhesive is applied to exterior surfaces 504 of inner top flaps 640 and/or 646 and/or interior surface 502 of outer top panels 628 and/or 634. First outer top panel 628 is rotated about fold line 630 to be substantially perpendicular to front wall 712 and coupled in face-to-face contact with inner top flaps 640 and 646. More specifically, interior surface 502 of first outer top panel 628 is in contact with or adjacent to exterior surface 504 of inner top flaps 640 and 646. Handle cutout 684 of first inner top flap 640, handle cutout 682 of second inner top flap 646, and handle flap 680 of first outer top panel 628 are substantially aligned with each other.

Second outer top panel 634 is rotated about fold line 636 to be substantially perpendicular to rear wall 724 and coupled in face-to-face contact with inner top flaps 640 and 646. Interior surface 502 of second outer top panel 634 is in contact with or adjacent to exterior surface 504 of inner top flaps 640 and 646. Handle cutout 682 of first inner top flap 640, handle cutout 684 of second inner top flap 646, and handle flap 680 of second outer top panel 634 are substantially aligned with each other. To facilitate carrying and/or transporting container 700, flaps 680 may be pushed into handle cutouts 682 and 684 by at least partially separating flaps 680 from outer top panel 628 and/or 634 at perforated lines 688 and by rotating flaps 680 into handle cutouts 682 and 684 at fold lines 686.

To dispense the liquid from the bladder within container 700, spout cutout 560 is at least partially removed from front wall 712 at perforated line 564. Optionally, removable flap 562 can be peeled back from spout cutout 560 upward to facilitate access to the outlet of the bladder. The user grasps the outlet of the bladder and positions the outlet of the bladder within spout cutout 560. Removable flap 562 can be re-positioned over the bladder to facilitate retaining the bladder within container 700.

The above-described method for forming container 700 from blank 500 can be performed manually and/or automatically. In the exemplary embodiment, at least walls 702, 704, 706, 708, 710, 712, 714, 716, 718, 720, 722, and 724 are formed automatically using a machine having a mandrel that is shaped to correspond to a cross-sectional shape of container 700.

Figure 7:
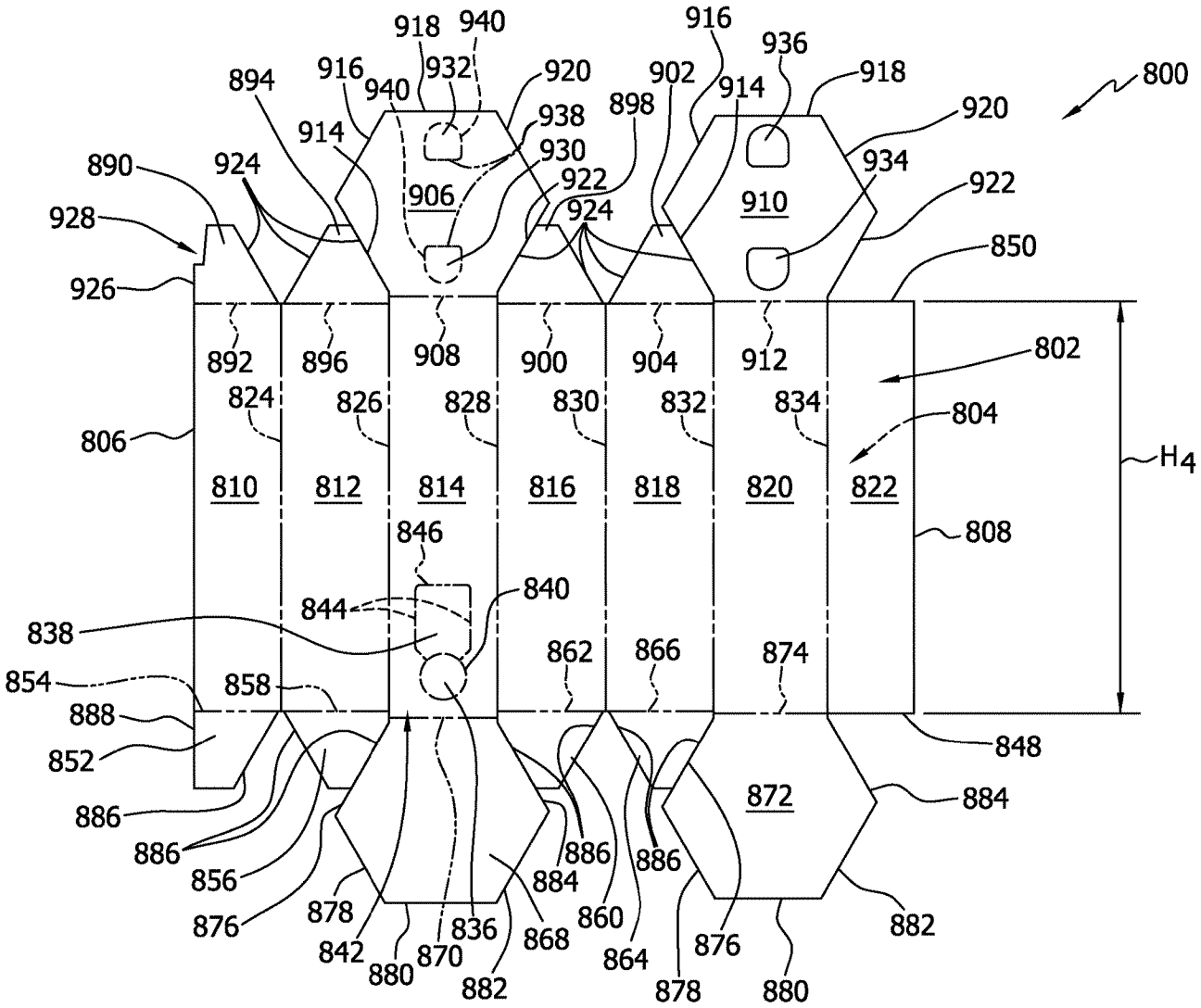

FIG. 7 is a top plan view of an example embodiment of a blank 800 of sheet material. A hexagonal container 950 (shown in FIG. 8) is formed from blank 800. Blank 800 has a first or interior surface 802 and an opposing second or exterior surface 804. Further, blank 800 defines a leading edge 806 and an opposing trailing edge 808. In one embodiment, blank 800 includes, in series from leading edge 806 to trailing edge 808, a first side panel 810, a second side panel 812, a front panel 814, a third side panel 816, a fourth side panel 818, a rear panel 820, and a glue panel 822 coupled together along preformed, generally parallel, fold lines 824, 826, 828, 830, 832, and 834, respectively. Front panel 814 and rear panel 820 are also considered to be end panels. Container 950 formed from blank 800 may be referred to as a beverage container, although it will be understood container 950 can be used to contain any suitable product(s).

First side panel 810 extends from leading edge 806 to fold line 824, second side panel 812 extends from first side panel 810 along fold line 824, front panel 814 extends from second side panel 812 along fold line 826, third side panel 816 extends from front panel 814 along fold line 828, fourth side panel 818 extends from third side panel 816 along fold line 830, rear panel 820 extends from fourth side panel 818 along fold line 832, and glue panel 822 extends from rear panel 820 along fold line 834 to trailing edge 808. Fold lines 824, 826, 828, 830, 832, and 834, as well as other fold lines and/or hinge lines described herein, may include any suitable line of weakening and/or line of separation known to those skilled in the art and guided by the teachings herein provided. In the exemplary embodiment, panels 810, 812, 814, 816, and 818 each have approximately the same width and rear panel 820 is wider than panels 810, 812, 814, 816, and 818. In alternative embodiments, panels 810, 812, 814, 816, 818, 820, and/or 822 may have any suitable widths to form hexagonal container 950. In the exemplary embodiment, a height $H_4$ of panels 810, 812, 814, 816, 818, 820, and/or 822 is larger than a width of each panel 810, 812, 814, 816, 818, 820, and/or 822.

In the exemplary embodiment, front panel 814 includes a spout cutout 836 and a removable flap 838. Spout cutout 836 is defined by a perforated line 840 and is positioned adjacent a bottom 842 of front panel 814. Spout cutout 836 is configured to correspond to an outlet (not shown) of an inner bladder (not shown) that is positioned within container 950. Alternatively, when blank 800 is formed from a liquid impermeable material, spout cutout 836 is configured to retain a spout (not shown) in flow communication with a cavity 966 (shown in FIG. 8) of container 950. In the exemplary embodiment, removable flap 838 is defined by perforated lines 844 and a top fold line 846 to enable removable flap 838 to be at least partially removed from front panel 814. Alternatively, removable flap 838 is defined by perforated lines that enable removable flap 838 to be completely detached from front panel 814. In the exemplary embodiment, removable flap 838 is configured to enable a user to access the bladder positioned within container 950 and to position the outlet of the bladder within spout cutout 836 when cutout 836 has been at least partially removed from front panel 814. Although perforated lines 844 are shown as being within front panel 814, perforated lines 844 may be at any suitable location with respect to front panel 814, second side panel 812, third side panel 816, fold line 826, and/or fold line 828.

Glue panel 822 has a bottom edge 848 and a top edge 850. A first bottom flap 852 extends from first side panel 810 along a fold line 854, a second bottom flap 856 extends from second side panel 812 along a fold line 858, a third bottom flap 860 extends from third side panel 816 along a fold line 862, and a fourth bottom flap 864 extends from fourth side panel 818 along a fold line 866. Fold lines 854, 858, 862, and 866 are slightly offset upwardly from bottom edge 848 to enable container 950 to be formed from blank 800. A first bottom panel 868 extends from front panel 814 along a fold line 870, and a second bottom panel 872 extends from rear panel 820 along a fold line 874. Fold lines 870 and 874 are offset downwardly from bottom edge 848 to enable container 950 to be formed from blank 800.

Bottom panels 868 and 872 are each substantially hexagon-shaped and substantially congruent. More specifically, each bottom panel 868 and 872 includes a first side edge 876, a second side edge 878, a first end edge 880, a third side edge 882, and a fourth side edge 884. Edges 876, 878, 880, 882, and 884 are free edges and are sized to correspond to the widths of panels 810, 812, 814, 816, 818, 820, and/or 822. A second end edge of each bottom panel 868 or 872 is defined by fold line 870 or 874, respectively. Bottom flaps 856, 860, and 864 are substantially congruent and trapezoidal-shaped with two slanting side edges 886. First bottom flap 852 is trapezoidal-shaped with one slanting side edge 886 and one side edge 888 that is substantially collinear with leading edge 806.

A first top flap 890 extends from first side panel 810 along a fold line 892, a second top flap 894 extends from second side panel 812 along a fold line 896, a third top flap 898 extends from third side panel 816 along a fold line 900, and a fourth top flap 902 extends from fourth side panel 818 along a fold line 904. Fold lines 892, 896, 900, and 904 are slightly offset downwardly from top edge 850 to enable container 950 to be formed from blank 800. A first top panel 906 extends from front panel 814 along a fold line 908, and a second top panel 910 extends from rear panel 820 along a fold line 912. Fold lines 908 and 912 are offset upwardly from top edge 850 to enable container 950 to be formed from blank 800.

Top panels 906 and 910 are each substantially hexagon-shaped and substantially congruent. More specifically, each top panel 906 and 910 includes a first side edge 914, a second side edge 916, a first end edge 918, a third side edge 920, and a fourth side edge 922. Edges 914, 916, 918, 920, and 922 are free edges and are sized to correspond to the widths of panels 810, 812, 814, 816, 818, 820, and/or 822. A second end edge of each top panel 906 or 910 is defined by fold line 908 or 912, respectively. Top flaps 894, 898, and 902 are substantially congruent and trapezoidal-shaped with two slanting side edges 924. First top flap 890 is trapezoidal-shaped with one slanting side edge 924 and one side edge 926 that is substantially collinear with leading edge 806. Side edge 926 includes a notch 928 defined therein.

In the exemplary embodiment, first top panel 906 includes a pair of semi-circular handle flaps 930 and 932. Second top panel 910 includes a pair of semi-circular handle cutouts 934 and 936. Each handle flap 930 and 932 is defined by a fold line 938 and a perforated line 940 to enable handle flap 930 and/or 932 to be at least partially removed from top panel 906. In an alternative embodiment, perforated line 940 is a cut line. In the exemplary embodiment, perforated line 940 enables handle flap 930 and/or 932 to be selectively folded into handle cutouts 934 and/or 936 as described in more detail herein. Further, it should be understood that handle cutout 934 and/or 936 and handle flap 930 and/or 932 can be any suitable shape, including semi-circular. In an alternative embodiment, in which second top panel 910 forms the outermost surface of container 950, second top panel 910 includes flaps 930 and 932 and first top panel 906 includes handle cutouts 934 and 936.

Figure 8:
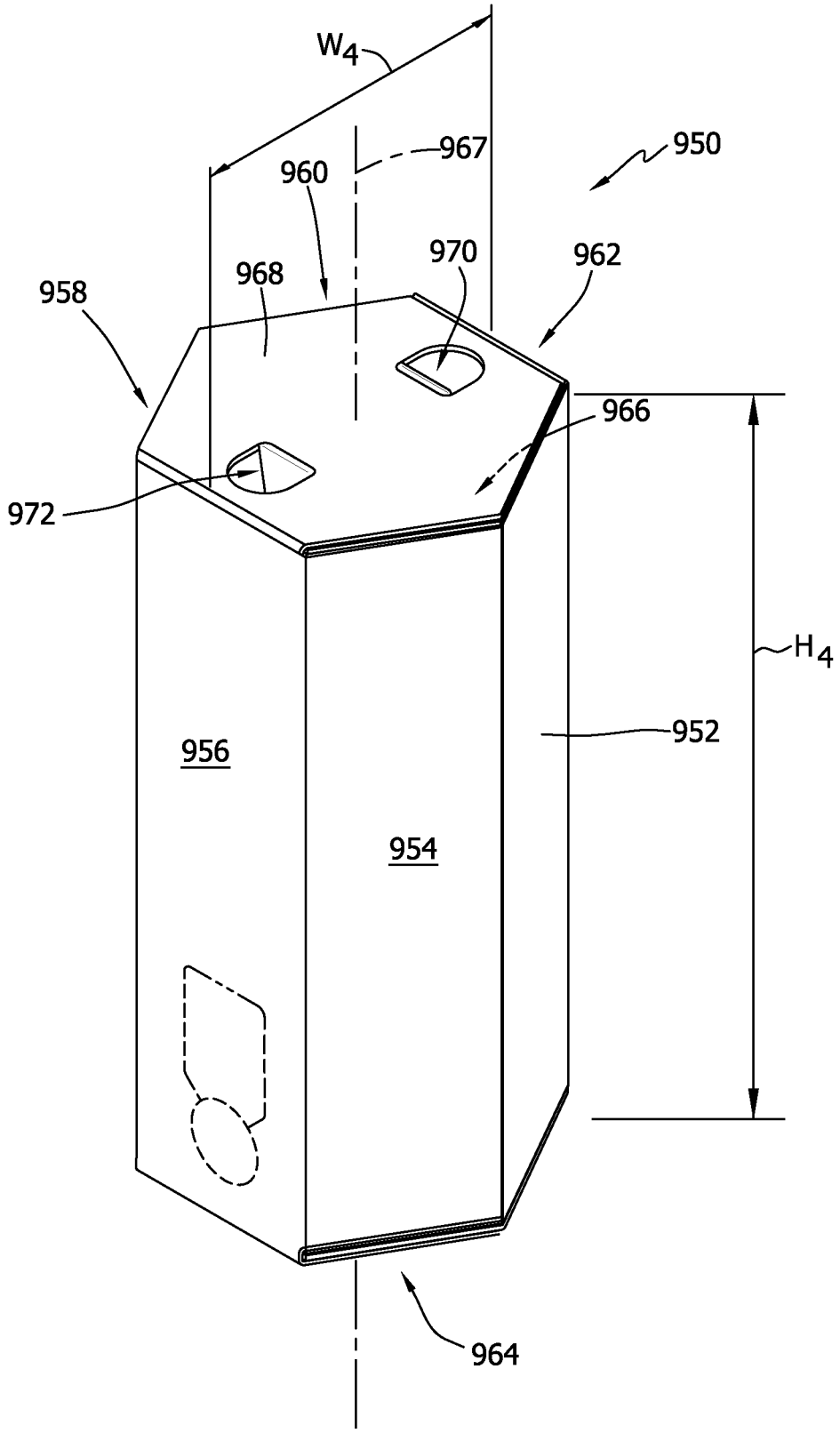

FIG. 8 is a perspective view of a container 950 formed from blank 800 (shown in FIG. 7). Referring to FIGS. 7 and 8, to construct container 950 from blank 800, first side panel 810 is rotated about fold line 824 toward interior surface 802 of second side panel 812, second side panel 812 is rotated about fold line 826 toward interior surface 802 of front panel 814, front panel 814 is rotated about fold line 828 toward interior surface 802 of third side panel 816, third side panel 816 is rotated about fold line 830 toward interior surface 802 of fourth side panel 818, fourth side panel 818 is rotated about fold line 832 toward interior surface 802 of rear panel 820, rear panel 820 is rotated about fold line 834 toward interior surface 802 of glue panel 822. Any suitable adhesive is applied to interior surface 802 of glue panel 822 and/or exterior surface 804 of first side panel 810. Glue panel 822 and first side panel 810 are coupled together to form a first side wall 952.

Second side panel 812 forms a second side wall 954, front panel 814 forms a front wall 956, third side panel 816 forms a third side wall 958, fourth side panel 818 forms a fourth side wall 960, and rear panel 820 forms a rear wall 962. First side wall 952 and third side wall 958 are substantially parallel, end walls 956 and 962 are substantially parallel, and second side wall 954 and fourth side wall 960 are substantially parallel.

Bottom flaps 852, 856, 860, and 864 are rotated about fold lines 854, 858, 862, and 866 to be substantially perpendicular to side walls 952, 954, 958, and 960. Any suitable adhesive is applied to exterior surfaces 804 of bottom flaps 852, 856, 860, and 864 and/or interior surface 802 of second bottom panel 872. Alternatively, adhesive is not applied to bottom flaps 852, 856, 860, and/or 864 and/or second bottom panel 872. In the exemplary embodiment, second bottom panel 872 is rotated about fold line 874 to be substantially perpendicular to rear wall 962 and in face-to-face relationship to bottom flaps 852, 856, 860, and 864. More specifically, interior surface 802 of second bottom panel 872 is directly adjacent to, and/or in contact with, exterior surface 804 of bottom flaps 852, 856, 860, and 864. First bottom panel 868 is then rotated about fold line 870 to be substantially perpendicular to front wall 956 and in face-to-face relationship to second bottom panel 872. In the exemplary embodiment, any suitable adhesive is applied to exterior surface 804 of second bottom panel 872 and/or interior surface 802 of first bottom panel 868, and first bottom panel 868 is coupled to second bottom panel 872. As such, second bottom panel 872 is positioned between bottom flaps 852, 856, 860, and 864 and first bottom panel 868. Alternatively, first bottom panel 868 is positioned between bottom flaps 852, 856, 860, and 864 and second bottom panel 872. In the exemplary embodiment, bottom flaps 852, 856, 860, and 864, first bottom panel 868, and second bottom panel 872 form a bottom wall 964 of container 950.

Walls 952, 954, 956, 958, 960, 962, and 964 define cavity 966 of container 950. A longitudinal axis 967 of container 950 extends substantially parallel to walls 952, 954, 956, 958, 960, and 962 and substantially perpendicular to bottom wall 964. Walls 952, 954, 956, 958, 960, and 962 each have height $H_4$ that is measured substantially parallel to longitudinal axis 967. As such, container 950 has height $H_4$. Further, container 950 has a width $W_4$ measured substantially perpendicularly to longitudinal axis 967 between opposing walls 952 and 958, 954 and 960, and/or 956 and 962. In the exemplary embodiment, height $H_4$ is about one-time (1×) to about three-times (3×) larger than width $W_4$.

A bladder (not shown) filled with a liquid, such as wine, is inserted into cavity 966 such that an outlet, such as a spout (not shown), of the bladder is adjacent spout cutout 836 and/or removable flap 838. Optionally, before the bladder is inserted into cavity 966, a sloped insert can be positioned adjacent bottom wall 964 to facilitate channeling liquid toward spout cutout 836. In a particular embodiment where container 950 is formed from a liquid impermeable material, a spout (not shown) is coupled to front wall 956 at spout cutout 836 and a liquid is directed into cavity 966.

To form a top wall 968 of container 950 and close container 950, top flaps 890, 894, 898, and 902 are rotated about fold lines 892, 896, 900, and 904, respectively, to be substantially perpendicular to side walls 952, 954, 958, and 960. Any suitable adhesive is applied to exterior surfaces 804 of top flaps 890, 894, 898, and/or 902 and/or interior surface 802 of second top panel 910. Alternatively, adhesive is not applied to top flaps 890, 894, 898, and/or 902 and/or second top panel 910. In the exemplary embodiment, second top panel 910 is rotated about fold line 912 to be substantially perpendicular to rear wall 962 and in face-to-face relationship to top flaps 890, 894, 898, and 902. More specifically, interior surface 802 of second top panel 910 is directly adjacent to, and/or in contact with, exterior surface 804 of top flaps 890, 894, 898, and/or 902. Handle cutout 934 is aligned with a gap between first top flap 890 and fourth top flap 902 to define a first top opening 970, and handle cutout 936 is aligned with a gap between second top flap 894 and third top flap 898 to define a second top opening 972.

First top panel 906 is then rotated about fold line 908 to be substantially perpendicular to front wall 956 and in face-to-face contact with second top panel 910. Flap 932 is substantially aligned with first top opening 970, and handle flap 930 is substantially aligned with second top opening 972. In the exemplary embodiment, any suitable adhesive is applied to exterior surface 804 of second top panel 910 and/or interior surface 802 of first top panel 906, and first top panel 906 is coupled to second top panel 910. As such, second top panel 910 is positioned between top flaps 890, 894, 898, and 902 and first top panel 906. Alternatively, first top panel 906 is positioned between top flaps 890, 894, 898, and 902 and second top panel 910. In the exemplary embodiment, top flaps 890, 894, 898, and 902, first top panel 906, and second top panel 910 form top wall 968 of container 950. To facilitate carrying and/or transporting container 950, handle flap 930 may be pushed into top opening 972 and/or flap 932 may be pushed into top opening 970 by at least partially separating handle flap 930 and/or 932 from first top panel 906 at perforated lines 940 and by rotating handle flap 930 and/or 932 into top opening 972 and/or 970 at fold lines 938.

To dispense the liquid from the bladder within container 950, spout cutout 836 is at least partially removed from front wall 956 at perforated line 840. Optionally, removable flap 838 can be peeled back from spout cutout 836 upward to facilitate access to the outlet of the bladder. The user grasps the outlet of the bladder and positions the outlet of the bladder within spout cutout 836. Removable flap 838 can be re-positioned over the bladder to facilitate retaining the bladder within container 950.

The above-described method for forming container 950 from blank 800 can be performed manually and/or automatically. In the exemplary embodiment, at least walls 952, 954, 956, 958, 960, and 962 are formed automatically using a machine having a mandrel that is shaped to correspond to a cross-sectional shape of container 950.

The above-described embodiments provide a polygonal container for dispensing a liquid. The polygonal containers described herein more closely approximate the shape of a bottle than other known, four-sided containers. Further, by including substantially flat walls rather than a cylindrical side wall, the containers described herein facilitate arranging a plurality of the containers in a space-efficient manner when storing and/or transporting the containers. Moreover, the handle flaps and handle cutouts described herein enable a user to transport and/or lift the container by selectively folding the flaps into the cutouts. When the handle flaps are not in use, the handle flaps do not extend above the top wall of the container. As such, the handle flaps do not interfere with stacking the containers and/or do not accidentally interlock with another object.

Additionally, the above-described spout cutout prevents the liquid within the container from being accidentally dispensed and/or tampered with before a consumer purchases the product within the container. More specifically, if the perforated lines about the spout cutout and/or flap are intact, the product within the container most likely has not been accessed.

In one aspect, a blank for forming a polygonal container is provided. The blank includes at least six panels coupled in series along a plurality of fold lines. The at least six panels includes two end panels and at least two side panels. The blank further includes a first bottom panel connected to a first end panel of the two end panels, a second bottom panel connected to a second end panel of the two end panels, and a spout cutout removably defined in the first end panel adjacent a fold line connecting the first end panel to the first bottom panel.

In another aspect, a container for dispensing beverages is provided. The container includes at least six walls coupled together along a plurality of parallel fold lines. The at least six walls include two end walls and at least two side walls. The container further includes a bottom wall coupled to at least the two end walls. A shape of the bottom wall corresponds to a cross-sectional shape of the at least six walls. The container also includes a spout cutout removably defined in a first end panel of the two end panels adjacent a fold line connecting the first end panel to the bottom wall.

In yet another aspect, a method for forming a polygonal container from a blank is provided. The blank includes at least six panels coupled in series along a plurality of fold lines. The at least six panels include two end panels and at least two side panels. The blank further includes a first bottom panel connected to a first end panel of the two end panels, a second bottom panel connected to a second end panel of the two end panels, and a spout cutout removably defined in the first end panel adjacent a fold line connecting the first end panel to the first bottom panel. The method includes rotating the at least six panels about the plurality of fold lines to form at least six walls, rotating the first bottom panel about the fold line connecting the first end panel to the first bottom panel, rotating the second bottom panel about a fold line connecting a second end panel of the at least two end panels to the second bottom panel, the first bottom panel and the second bottom panel forming a bottom wall of the container, and positioning a spout within the spout cutout to dispense a liquid from the container.

Exemplary embodiments of liquid dispensing containers and blanks for making the same are described above in detail. The methods and apparatus are not limited to the specific embodiments described herein, but rather, components of apparatus and/or steps of the methods may be utilized independently and separately from other components and/or steps described herein. For example, the methods may also be used in combination with other blanks, containers, and methods, and are not limited to practice with only the blanks, containers, and methods as described herein. Rather, the exemplary embodiment can be implemented and utilized in connection with many other liquid dispensing applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank for forming a polygonal container configured to include a liquid-impermeable bag having a dispensing fixture, the blank comprising:

a plurality of substantially rectangular panels coupled together along a plurality of parallel fold lines, wherein each of the plurality of panels has a height defined parallel to the plurality of parallel fold lines, the plurality of panels including, in series, a first corner panel, a first end panel, a second corner panel, a first side panel, a third corner panel, a second end panel, a fourth corner panel, a second side panel, and a glue panel, wherein a width of each of the four corner panels is less than a width of each of the side panels and a width of each of the end panels;

at least one bottom panel, each of the at least one bottom panels connected along a bottom edge of one of the side panels and the end panels, the at least one bottom panel configured to form a bottom wall defining a container width between the first and second end panels when the container is formed, wherein the height is within a range of about 1.times. to about 3.times. the container width; and a spout cutout removably defined in one of the end panels, the spout cutout is proximate to the bottom edge of the respective one of the side panels and the end panels, the spout cutout configured to receive the dispensing fixture for dispensing a liquid from the liquid-impermeable bag when positioned within the container, and wherein the width of each of the end panels is at least as great as the width of each of the side panels.

2. A blank in accordance with claim 1, wherein the at least one bottom panel comprises a first bottom panel connected along the bottom edge of the first end panel, and a second bottom panel connected along the bottom edge of the second end panel.

3. A blank in accordance with claim 2, wherein each of the first and second bottom panels has a generally octagonal shape.

4. A blank in accordance with claim 2, wherein each of the first and second bottom panels has a generally hemi-octagonal shape.

5. A blank in accordance with claim 1, wherein the height is within a range of about 1.5.times. to about 2.5.times. the container width.

6. A blank in accordance with claim 1, wherein the height is within a range of about 2.0.times. to about 2.3.times. the container width.

7. A container for dispensing a beverage, the container comprising:

a plurality of substantially rectangular walls coupled together along a plurality of parallel fold lines, wherein a height of the container is defined parallel to the plurality of parallel fold lines, the plurality of walls including, in series, a first corner wall, a first end wall, a second corner wall, a first side wall, a third corner wall, a second end wall, a fourth corner wall, and a second side wall, wherein a width of each of the four corner walls is less than a width of each of the side walls and a width of each of the end walls;

a bottom wall emanating from a bottom edge of at least one of the side walls and the end walls, the bottom wall defining a container width between the first and second end walls, wherein the height is within a range of about 1.times. to about 3.times. the container width; and a spout cutout removably defined in one of the end walls proximate to the bottom edge of the respective one of the side walls and the end walls, the spout cutout configured to receive a dispensing fixture for dispensing the beverage from a liquid-impermeable bag when the bag is positioned within the container;

wherein the width of each of the first and second end walls is at least as great as the width of each of the first and second side walls.

8. A container in accordance with claim 7, wherein the bottom wall comprises a first bottom panel emanating from the bottom edge of the first end wall, and a second bottom panel emanating from the bottom edge of the second end wall.

9. A container in accordance with claim 8, wherein each of the first and second bottom panels has a generally octagonal shape.

10. A container in accordance with claim 8, wherein each of the first and second bottom panels has a generally hemi-octagonal shape.

11. A container in accordance with claim 7, wherein the height is within a range of about 1.5.times. to about 2.5.times. the container width.

12. A container in accordance with claim 7, wherein the height is within a range of about 2.0.times. to about 2.3.times. the container width.

13. A method for forming a polygonal container from a blank that includes a plurality of substantially rectangular panels coupled together along a plurality of parallel fold lines, wherein each of the plurality of panels has a height defined parallel to the plurality of parallel fold lines, the plurality of panels including, in series, a first corner panel, a first end panel, a second corner panel, a first side panel, a third corner panel, a second end panel, a fourth corner panel, a second side panel, and a glue panel, wherein a width of each of the four corner panels is less than a width of each of the side panels and a width of each of the end panels, and wherein the width of each of the first and second end walls is at least as great as the width of each of the first and second side walls, the method comprising:

rotating the plurality of panels about the plurality of parallel fold lines and coupling the glue panel to the first corner panel to form a plurality of walls;

rotating at least one bottom panel about a fold line connecting each at least one bottom panel to a bottom edge of a respective panel of the side panels and the end panels to form a bottom wall of the container, the bottom wall defining a container width between the first and second end panels, wherein the height is within a range of about 1.times. to about 3.times. the container width; and removing a spout cutout defined proximate to the bottom edge of one of the side panels and the end panels to facilitate dispensing a liquid from the container.

14. A method in accordance with claim 13, further comprising positioning a spout within the spout cutout and inserting a bladder at least partially filled with the liquid into a cavity of the container, the cavity defined by the plurality of walls and the bottom wall, the spout being coupled to the bladder.

15. A method in accordance with claim 13, wherein rotating the plurality of panels about the plurality of parallel fold lines to form the plurality of walls further comprises rotating the plurality of panels about the plurality of parallel fold lines to form, in series, a first corner wall, a first end wall, a second corner wall, a first side wall, a third corner wall, a second end wall, a fourth corner wall, and a second side wall.

16. A method in accordance with claim 13, wherein rotating the plurality of panels about the plurality of parallel fold lines to form the plurality of walls further comprises rotating the plurality of panels about the plurality of parallel fold lines to form, in series, a first corner wall, a first end wall, a second corner wall, a first side wall, a third corner wall, a second end wall, a fourth corner wall, and a second side wall.

17. A method in accordance with claim 13, wherein rotating the at least one bottom panel to form the bottom wall further comprises: rotating a first bottom panel about a fold line connecting the first bottom panel to the bottom edge of the first end panel; and rotating a second bottom panel about a fold line connecting the second bottom panel to the bottom edge of the second end panel, wherein each of the first and second bottom panels has a generally octagonal shape.

18. A method in accordance with claim 13, wherein rotating the at least one bottom panel to form the bottom wall further comprises: rotating a first bottom panel about a fold line connecting the first bottom panel to the bottom edge of the first end panel; and rotating a second bottom panel about a fold line connecting the second bottom panel to the bottom edge of the second end panel, wherein each of the first and second bottom panels has a generally hemi-octagonal shape.

19. A method in accordance with claim 13, wherein rotating the at least one bottom panel to form the bottom wall further comprises rotating the at least one bottom panel to form the bottom wall such that the height is within a range of about 1.5.times. to about 2.5.times. the container width.

20. A method in accordance with claim 13, wherein rotating the at least one bottom panel to form the bottom wall further comprises rotating the at least one bottom panel to form the bottom wall such that the height is within a range of about 2.0.times. to about 2.3.times. the container width.

* * * * *